US012384493B2

(12) United States Patent
Czarnowski et al.

(10) Patent No.: US 12,384,493 B2
(45) Date of Patent: Aug. 12, 2025

(54) DRAIN MECHANISM FOR WATERCRAFT

(71) Applicant: Hobie Cat IP, LLC, Livonia, MI (US)

(72) Inventors: James Taylor Czarnowski, Fallbrook, CA (US); Drew William Brackett, Solana Beach, CA (US)

(73) Assignee: Hobie Cat IP, LLC, Livonia, MI (US)

( * ) Notice: Subject to any disclaimer, the term of this patent is extended or adjusted under 35 U.S.C. 154(b) by 759 days.

(21) Appl. No.: 17/547,860

(22) Filed: Dec. 10, 2021

(65) Prior Publication Data

US 2023/0182865 A1 Jun. 15, 2023

(51) Int. Cl.
*B63B 13/00* (2006.01)
*B63B 19/26* (2006.01)

(52) U.S. Cl.
CPC ..... *B63B 13/00* (2013.01); *B63B 19/26* (2013.01)

(58) Field of Classification Search
None
See application file for complete search history.

(56) References Cited

U.S. PATENT DOCUMENTS 7,320,291 B2 * 1/2008 Eckert ..... B63B 34/23 114/347
8,082,871 B2 * 12/2011 Czarnowski ..... B63B 34/22 114/345
8,753,156 B2 * 6/2014 Ketterman ..... B63H 25/42 440/26
D939,421 S * 12/2021 Li ..... D12/214
11,447,222 B2 * 9/2022 Boyer ..... B63H 16/16
11,649,028 B2 * 5/2023 Boyer ..... B63B 34/20 440/38
2017/0113763 A1 * 4/2017 McDonough ..... B63B 34/26
2022/0332399 A1 * 10/2022 Cooper ..... B63H 25/10

OTHER PUBLICATIONS westcoastsailing.net [online], "Laser Autobailer Assembly (Nautos)," retrieved on Mar. 30, 2022, retrieved from URL <https://westcoastsailing.net/laser-autobailer-nautos/?gclid=Cj0KCQjw_4-SBhCgARIsAAlegrWoM2093Z_EnT-FV5Y1n64NcchYaZDKVagyPlu4M2VhO92dwhzi2vEaAkitEALw_wcB>, 7 pages.
intensitysails.com [online], "Auto Bailer for Laser® by Holt Nautos," retrieved on Mar. 30, 2022, retrieved from URL <https://www.intensitysails.com/autobailer.html>, 3 pages.
nextadventure.net [online], "Hobie Drain Assembly Sport-Oasis-TI," retrieved on Mar. 30, 2022, retrieved from URL <https://www.nextadventure.net/catalog/product/view/id/164477/s/drain-assy-sport-oasis-ti-055488/>, 4 pages.

* cited by examiner

*Primary Examiner* — S. Joseph Morano
*Assistant Examiner* — Jovon E Hayes
(74) *Attorney, Agent, or Firm* — Fish & Richardson P.C.

(57) ABSTRACT

A watercraft includes a hull, an opening extending through the hull, the opening configured to receive a removable propulsion mechanism, and an insert removably insertable into the opening. The insert includes an inner cavity, an aperture configured to be at least partially submerged in a fluid when the watercraft is positioned on the fluid, the aperture being configured to provide fluid communication between the inner cavity of the insert and the fluid as the watercraft travels in a forward direction, and a surface shaped and dimensioned such that a first pressure within the inner cavity is greater than a second pressure at the aperture as the watercraft travels in the forward direction.

28 Claims, 18 Drawing Sheets

DRAIN MECHANISM FOR WATERCRAFT

TECHNICAL FIELD

This specification relates to a drain mechanism for a watercraft.

BACKGROUND

A personal watercraft can include a hull for carrying one or more passengers. The hull of the watercraft floats when the watercraft is placed on a body of water. As the watercraft travels along the body of water, the hull of the watercraft may collect water. For example, water can splash onto the hull, or the watercraft can include features that enable water to flow into the hull, such as an opening exposed to the body of water. The collected water can be bailed out of the watercraft to prevent objects and people on the hull from getting wet and to prevent excessive water mass from being collected on the hull.

SUMMARY

This disclosure features a watercraft that includes a drain mechanism that drains water from a hull of the watercraft as the watercraft travels across a body of water. In some examples in this disclosure, the hull can include an opening that can receive a modular device (e.g., a removable propulsion mechanism, a removable sensing device, an insert, or other device that can be mounted to and dismounted from the opening) that contacts the body of water. In examples in which the modular device is a removable propulsion mechanism, the removable propulsion mechanism can be operable to drive the watercraft across the water. The opening, however, is exposed to the body of water and can allow water to flow onto the hull, thus possibly inadvertently wetting objects on the hull. The likelihood of water flowing onto the hull can increase when the propulsion mechanism is removed from the opening, thus exposing an upper portion of the hull through an entirety of the opening to the body of water.

To prevent water from flowing onto the upper portion of the hull, an insert can be placed in the opening. This insert can include structures that discourage water from flowing onto the hull and, in particular, can include an aperture that limits exposure of the upper portion of the hull to the body of water as the watercraft travels across the body of water. In addition, as the watercraft travels across the body of water, the structures of the insert can interact with the water displaced by the watercraft in such a way that a low pressure zone is created near the aperture through the Venturi effect. In this low pressure zone, the pressure on one side of the aperture (e.g., the side within the body of water) can be lower than the pressure on the other side of the aperture (e.g., the side within the insert). As a result of the low pressure zone on the side of the aperture within the body of water, water collected in the insert (e.g., including water that flows through the aperture or water that is collected in the insert through other splashing or other mechanisms) can have a tendency to be pulled back through the aperture into the body of water, thus preventing the upper portion of the hull from collecting too much water.

In one aspect, a watercraft is featured. The watercraft includes a hull, an opening extending through the hull, the opening configured to receive a removable propulsion mechanism, and an insert removably insertable into the opening. The insert includes an inner cavity, an aperture configured to be at least partially submerged in a fluid when the watercraft is positioned on the fluid, the aperture being configured to provide fluid communication between the inner cavity of the insert and the fluid as the watercraft travels in a forward direction, and a surface shaped and dimensioned such that a first pressure within the inner cavity is greater than a second pressure at the aperture as the watercraft travels in the forward direction.

In another aspect, an insert is featured. The insert is configured to be received in an opening extending through a hull of a watercraft. The opening is configured to receive a removable pedal-driven propulsion system. The insert includes an inner cavity, an aperture configured to be at least partially submerged in a fluid when the watercraft is positioned on the fluid, the aperture being configured to provide fluid communication between the inner cavity of the insert and the fluid as the watercraft travels in a forward direction, and a surface shaped and dimensioned such that a first pressure within the inner cavity is greater than a second pressure at the aperture as the watercraft travels in the forward direction.

In some implementations, the opening is defined by the hull.

In some implementations, a support assembly within the opening. The support assembly can be configured to receive the removable propulsion mechanism. The insert can be removably insertable into the support assembly.

In some implementations, the aperture is located at a first location rearward a second location, and the surface is shaped and dimensioned such that a first fluid pressure at the first location is lower than a second fluid pressure at the second location along the insert as the watercraft travels in the forward direction. In some implementations, the first location is along a rear portion of the insert, and the second location is along a forward portion of the insert.

In some implementations, the surface is angled relative to the forward direction such that a forward portion of the surface is above a rearward portion of the surface. In some implementations, the surface is substantially planar.

In some implementations, the insert includes one or more lateral walls extending upwardly from the surface, the one or more lateral walls at least partially define the aperture and the inner cavity.

In some implementations, the insert includes a lower wall and one or more lateral walls, the lower wall at least partially defining the surface, and the lower wall and the one or more lateral walls at least partially defining the inner cavity. In some implementations, the one or more lateral walls are configured to extend along at least part of a perimeter of the opening when the insert is received within the opening.

In some implementations, the insert includes a shaft on a first side portion of the insert, the shaft engageable with a bearing surface within the opening. In some implementations, the watercraft further includes a locking assembly to releasably lock the shaft of the insert to the watercraft when the insert is received within the opening. In some implementations, the watercraft further includes a support assembly within the opening. The support assembly can be configured to receive the removable propulsion mechanism. The insert can be removably insertable into the support assembly. The support assembly can include the locking assembly. In some implementations, the hull includes the locking assembly. In some implementations, the shaft is a first shaft, the bearing surface is a first bearing surface, and the insert includes a second shaft on a second side portion of the insert, the second shaft engageable with a second bearing surface. In some implementations, the hull or a support assembly within the opening defines the first and second bearing surfaces. In some implementations, the insert includes a handle extending from the first shaft to the second shaft.

In some implementations, the insert includes a longitudinal support member positioned to engage with a bearing surface within the opening.

In some implementations, the aperture is configured to extend to a location below the opening when the insert is mounted within the opening.

In some implementations, the watercraft further includes the removable propulsion mechanism. The removable propulsion mechanism can be a pedal-driven system.

In some implementations, the surface is shaped and dimensioned such that the first pressure within the inner cavity is greater than the second pressure at the aperture when a speed of the watercraft as the watercraft travels in the forward direction is between 2.5 and 20 meters per second.

In some implementations, the surface is shaped and dimensioned such that a difference between the first pressure and the second pressure is between 6,250 and 400,000 MPa.

In some implementations, the insert includes a flap adjacent to the aperture, the flap being movable between an open position and a closed position, and the flap configured to be in the open position as the watercraft travels in the forward direction and configured to be in the closed position as the watercraft travels in a rearward direction.

In some implementations, the insert further includes a lower wall defining the surface, and one or more lateral walls extending away from the lower wall. The one or more lateral walls and the aperture can extend along an entirety of a perimeter of the lower wall. The inner cavity can be at least partially defined by the lower wall and the one or more lateral walls. In some implementations, the surface is angled relative to the forward direction such that a forward portion of the surface is above a rearward portion of the surface.

In some implementations, the insert further includes a left shaft along a left side of the insert, the left shaft configured to bear against a left bearing surface in the opening of the watercraft when the insert is mounted to the watercraft, and a right shaft along a right side of the insert, the right shaft configured to bear against a right bearing surface in the opening of the watercraft when the insert is mounted to the watercraft. In some implementations, the insert further includes a forward support member along a forward portion of the insert, the forward support member configured to bear against a forward bearing surface in the opening of the watercraft when the insert is mounted to the watercraft, and a rearward support member along a rearward portion of the insert, the rearward support member configured to bear against a rearward bearing surface in the opening of the watercraft when the insert is mounted to the watercraft.

Advantages of the systems and methods described in this disclosure may include those described below and elsewhere in this disclosure. First, the insert can drain water from the watercraft in a passive manner and thus allows water to be removed from the watercraft without the use of heavy and costly pumps. Second, the insert can be easily and cheaply manufactured, for example, using injection molding techniques. Third, in examples in which the watercraft includes an opening for receiving a modular device, the insert can be easily exchanged with the modular device and can be easily locked to the hull, for example, using a locking mechanism within the opening.

The details of one or more implementations of the subject matter described in this specification are set forth in the accompanying drawings and the description below. Other potential features, aspects, and advantages will become apparent from the description, the drawings, and the claims.

DETAILED DESCRIPTION

Figure 1:
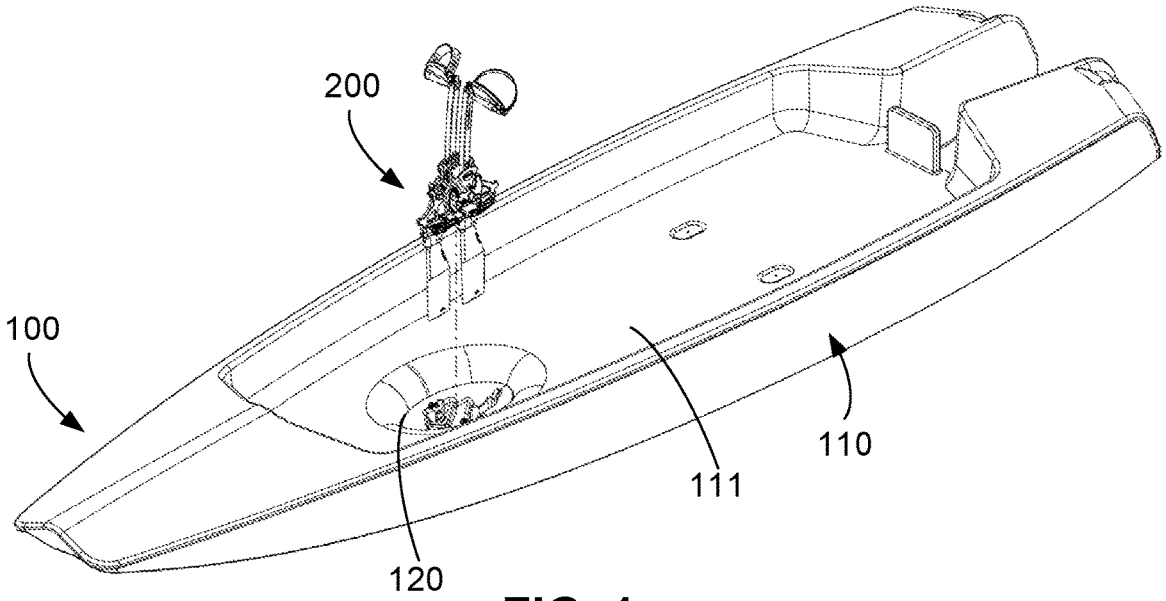
FIGS. 1 and 2 are top perspective exploded views of a watercraft, with FIG. 1 showing the watercraft with a removable propulsion mechanism, and FIG. 2 showing the watercraft with a removable insert for draining water.
Figure 2:
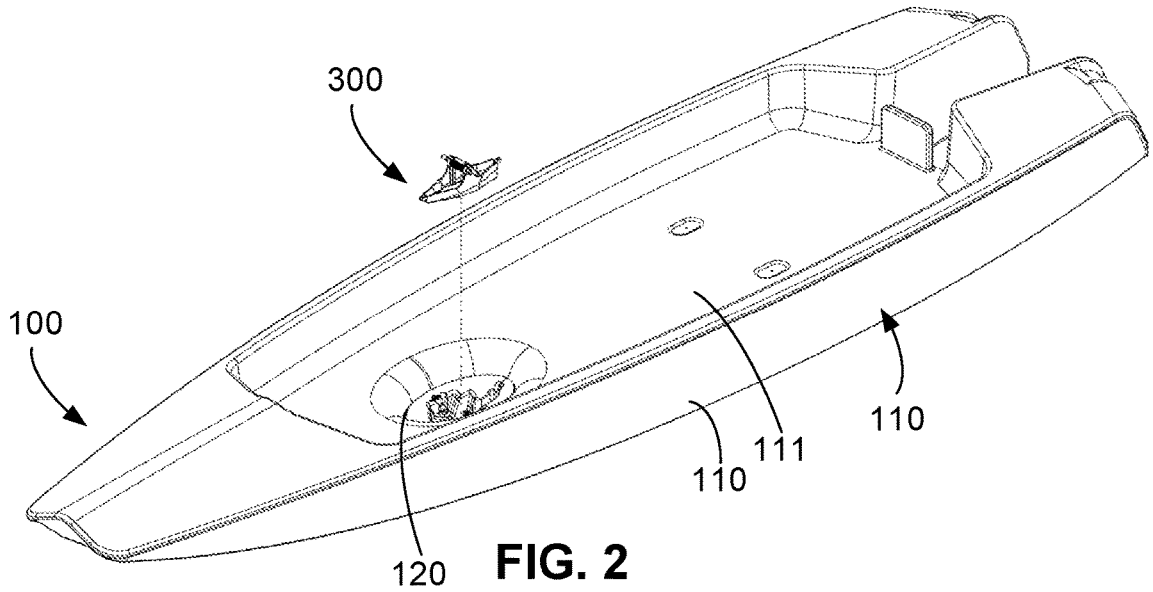

Referring to FIGS. 1 and 2, a watercraft 100 includes a hull 110 and an opening 120 extending through the hull 110, e.g., vertically through the hull 110. The opening 120 is configured to receive and support removable devices that, for example, enable a user of the watercraft 100 to propel the watercraft 100 across a body of water. FIG. 1 illustrates an example in which a removable propulsion mechanism 200 is insertable into the opening 120, the removable propulsion mechanism 200 being a manually operable propulsion mechanism with pedals that can be driven by the user to propel the watercraft 100 across the body of water. The removable propulsion mechanism 200 can be removed from the watercraft 100, thereby exposing an upper portion 111 of the hull 110 to the body of water on which the watercraft 100 is positioned. As discussed in this disclosure, an insert 300 can be removably inserted into the opening 120 to partially obstruct water from flowing or splashing onto the upper portion 111 of the hull 110. In addition, the insert 300 can, as described in greater detail in this disclosure, include structure and geometry that uses the Venturi effect to encourage drainage of water on the watercraft into the body of water.

Figure 3:
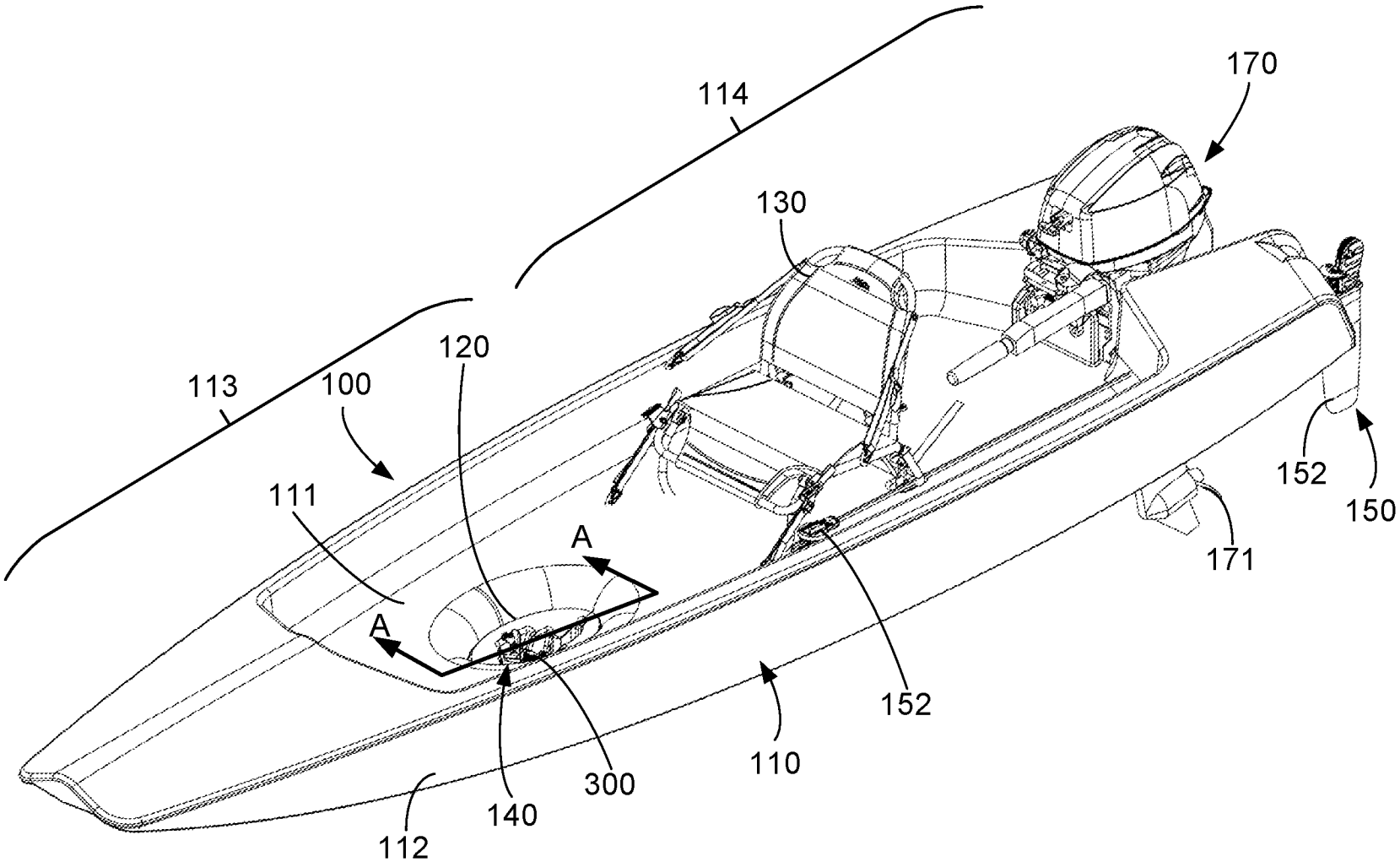
FIG. 3 is a top perspective view of a watercraft including a removable insert for draining water.

FIG. 3 illustrates an exemplary implementation of a watercraft including an insert. In particular, the watercraft 100 shown in FIG. 3 includes the insert 300 in the opening 120 of the watercraft 100. In the example depicted in FIG. 3, the watercraft 100 is a personal kayak that can sit one passenger. The hull 110 of the watercraft 100 includes the upper portion 111, a lower portion 112, a forward portion 113, and a rearward portion 114. In addition to including the hull 110 and the insert 300, the watercraft 100 includes a chair 130 on the upper portion 111 and the rearward portion 114 of the hull 110, an outboard motor system 170 on the rearward portion 114 of the hull 110, and a rudder mechanism 150 on the rearward portion 114 of the hull 110. As discussed above, the opening 120 is also configured to receive the removable propulsion mechanism 200. In particular, the removable propulsion mechanism 200 can be exchanged with the insert 300 to allow the user to manually drive the watercraft 100 through the body of water. In the example shown in FIG. 3, the watercraft 100 includes a support assembly 140 within the opening 120 that is configured to receive the removable propulsion mechanism 200, and is also configured to receive the insert 300.

The outboard motor system 170 is operable to propel the watercraft 100 through the body of water. The outboard motor system 170 includes a motor that, when driven, rotates a propeller 171. Rotation of the propeller 171 through the body of water causes the watercraft 100 to be propelled through the body of water in a forward direction of the watercraft 100. The motor can be operated in reverse to allow rotation of the propeller 171 through the body of water such that the watercraft is propelled through the body of water in a rearward direction of the watercraft 100. The outboard motor system 170 can be dismounted from the watercraft 100, thereby reducing the weight of the watercraft 100.

The rudder mechanism 150 is operable to steer the watercraft 100 as the watercraft 100 is driven in the forward direction or in the rearward direction. The rudder mechanism 150 can be manually operable. For example, the rudder mechanism 150 includes a rudder 151 that is movably mounted to the watercraft 100 and a handle 152 mounted to the upper portion 111 of the hull 110 to allow the user to access and manipulate the handle 152. When manipulated, the handle 152 causes the rudder 151 to rotate, thereby allowing the user to steer the watercraft 100 as the watercraft 100 is propelled through the body of water, e.g., via the removable propulsion mechanism 200 (shown in FIG. 1) or via the outboard motor system 170. The handle 152 can be located adjacent to the chair 130 such that the user can easily access the handle 152 when the user is sitting in the chair 130. In addition, when sitting in the chair, the user can easily access the removable propulsion mechanism 200 when the removable propulsion mechanism 200 is inserted into the opening 120. Thus the user can simultaneously propel the watercraft 100 through manual efforts and also steer the watercraft 100 as the watercraft 100 is being propelled.

Figure 4:
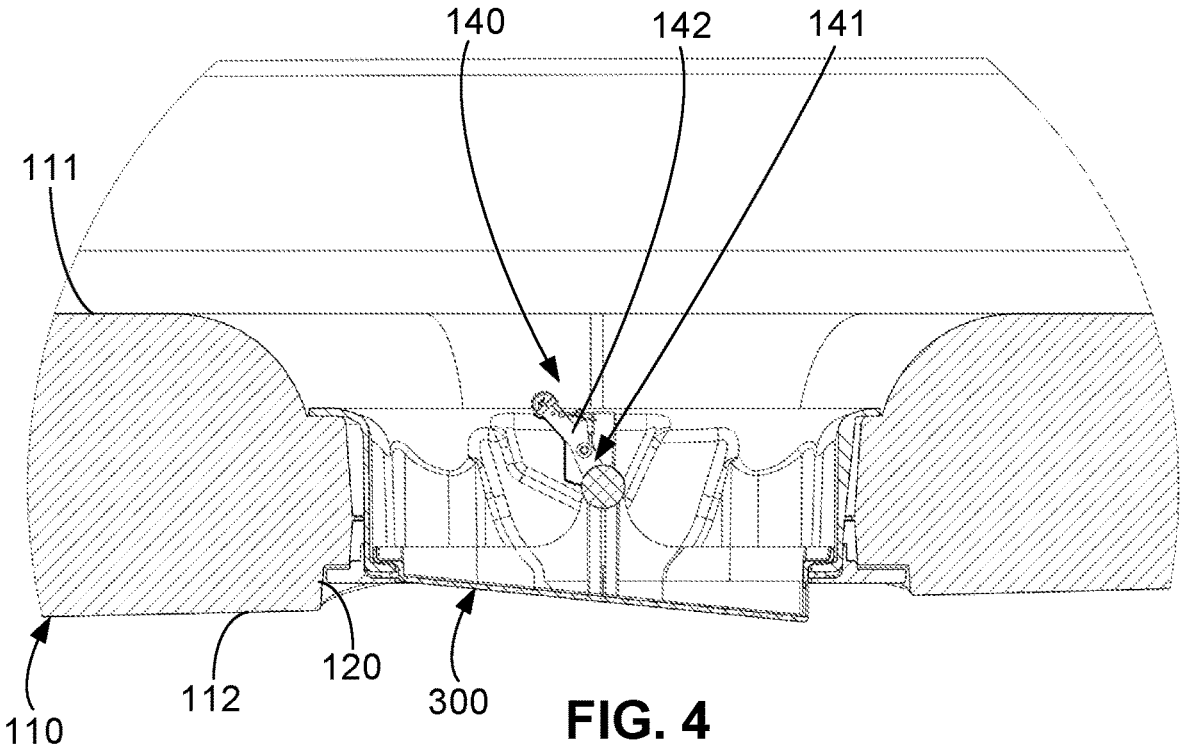
FIG. 4 is a side cross-sectional view of a portion of the watercraft through the section line A-A in FIG. 3.

FIG. 4 illustrates the insert 300 removably inserted into the opening 120 through the hull 110. The opening 120 is defined by the hull 110. The opening 120 is a through-opening that extends from the upper portion 111 of the hull 110, through the hull 110, and to the lower portion 112 of the hull 110. The support assembly 140 is located within the opening 120. The support assembly 140 includes a locking assembly 141 to releasably lock a portion of a modular assembly, e.g., the removable propulsion mechanism 200 or the insert 300, to the hull 110. The locking assembly 141, for example, can include one or more manually operable arms, e.g., a manually operable arm 142 shown in FIG. 4, that engages with part of the modular assembly to releasably lock the modular assembly to the hull 110. In the example shown in FIG. 4, the insert 300 corresponds to the modular assembly. The support assembly 140, in some implementations, is a separate component that is received within the opening 120. The support assembly 140 in turn is configured to receive the removable propulsion mechanism 200 and is also configured to receive the insert 300. In other implementations, as described in greater detail in this disclosure, the support assembly 140 is at least in part integral with the hull 110.

FIGS. 5A-5E illustrate an exemplary implementation of a drain mechanism for a watercraft. In particular, an example of the insert 300 is depicted. The insert 300 is a structure that can be mounted in the opening 120 for draining water from the hull 110 of the watercraft 100. In the example shown, the insert 300 includes an inner cavity 310 extending through an upper portion 301 and a lower portion 302 of the insert 300 and an aperture 320 along a rearward portion 304 and the lower portion 302 of the insert 300. The insert 300 further includes a lower wall 330 extending from a forward portion 303 to the rearward portion 304 of the insert 300 and along the lower portion 302 of the insert 300 and lateral walls 340 extending around an outer perimeter of the insert 300. The insert 300 also includes a handle 350 on an upper portion 301 of the insert 300. The insert 300 also includes mounting shafts 360 on the upper portion 301 of the insert 300 and longitudinal support members 370 on the forward portion 303 and the rearward portion 304.

Figure 5A:
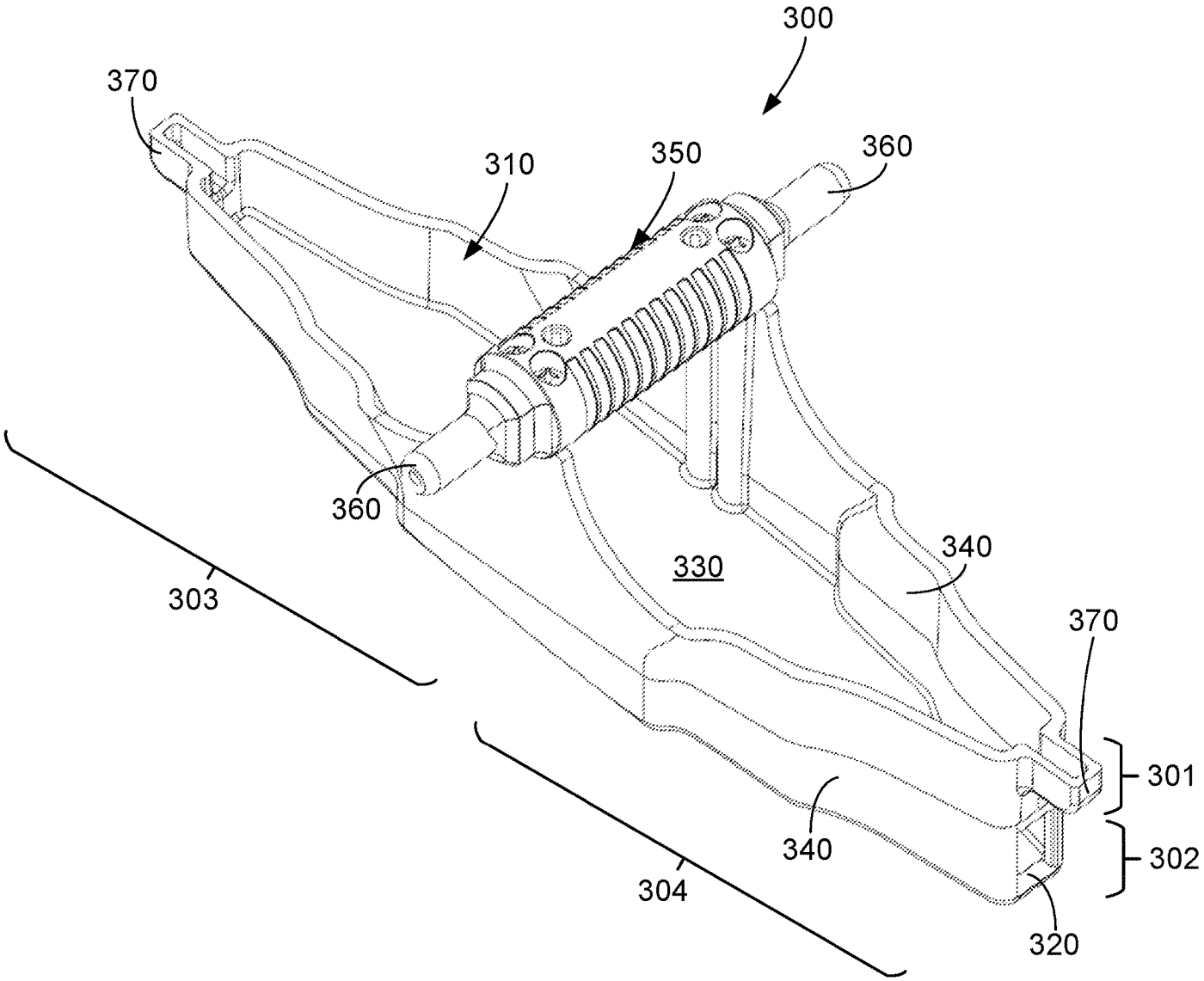
FIGS. 5A-5E are top-rear perspective, bottom-rear perspective, top, side, and side cross-sectional views of a removable insert for draining water.

The inner cavity 310 serves as a reservoir for collecting water that is drained into the body of water through the insert 300. Referring to FIGS. 5A and 5C, the inner cavity 310 is defined by outer walls of the insert 300, e.g., the lower wall 330 and the lateral walls 340. The inner cavity 310 extends through at least 75% of a length of the insert 300, e.g., at least 80%, 85%, 90%, or 95% of the length of the insert 300. In implementations, the length of the insert 300 is between 20 and 40 centimeters (e.g., between 20 and 30 centimeters, between 25 and 35 centimeters, between 30 and 40 centimeters, about 25 centimeters, about 30 centimeters, about 35 centimeters, etc.). The insert 300 and its outer walls are shaped to fit within the opening 120 of the watercraft 100. Thus in the example of the watercraft 100 shown in FIGS. 3-4 in which the opening 120 has a substantially elliptical shape, the outer walls of the insert 300 and the inner cavity 310 form elongate shapes that allow the insert 300 to fit within the opening 120 of the watercraft 100 and that allow the inner cavity 310 to provide sufficient volume for the inner cavity 310 to serve as a reservoir for water.

The inner cavity 310 is directly connected to the aperture 320, thus allowing fluid flow through the aperture 320 into the inner cavity 310 and fluid flow from the inner cavity 310 through the aperture 320 and out of the insert 300. The inner cavity 310 also occupies a sufficient volume to serve as a reservoir for fluid that flows through the aperture 320. For example, the volume occupied by the inner cavity 310 is between 0.5 and 2.5 liters (e.g., between 0.5 and 1.5 liters, between 1 and 2 liters, between 1.5 and 2.5 liters, about 1 liter, about 1.5 liters, about 2 liters, etc.). Indeed, in the example shown in FIGS. 5A-5E, the aperture 320 corresponds to the only fluid conduit into the inner cavity 310 through the lower portion 302 of the insert 300.

In addition, the inner cavity 310 is exposed from above, e.g., exposed to the atmosphere, during use of the watercraft 100. The inner cavity 310 thus is exposed to fluid from both above and below. Typically, during use of the watercraft 100, the inner cavity 310 is exposed to water from below, e.g., through the aperture 320, and is exposed to atmosphere or air from above, e.g., through the upper portion 301 of the insert 300.

Figure 5B:
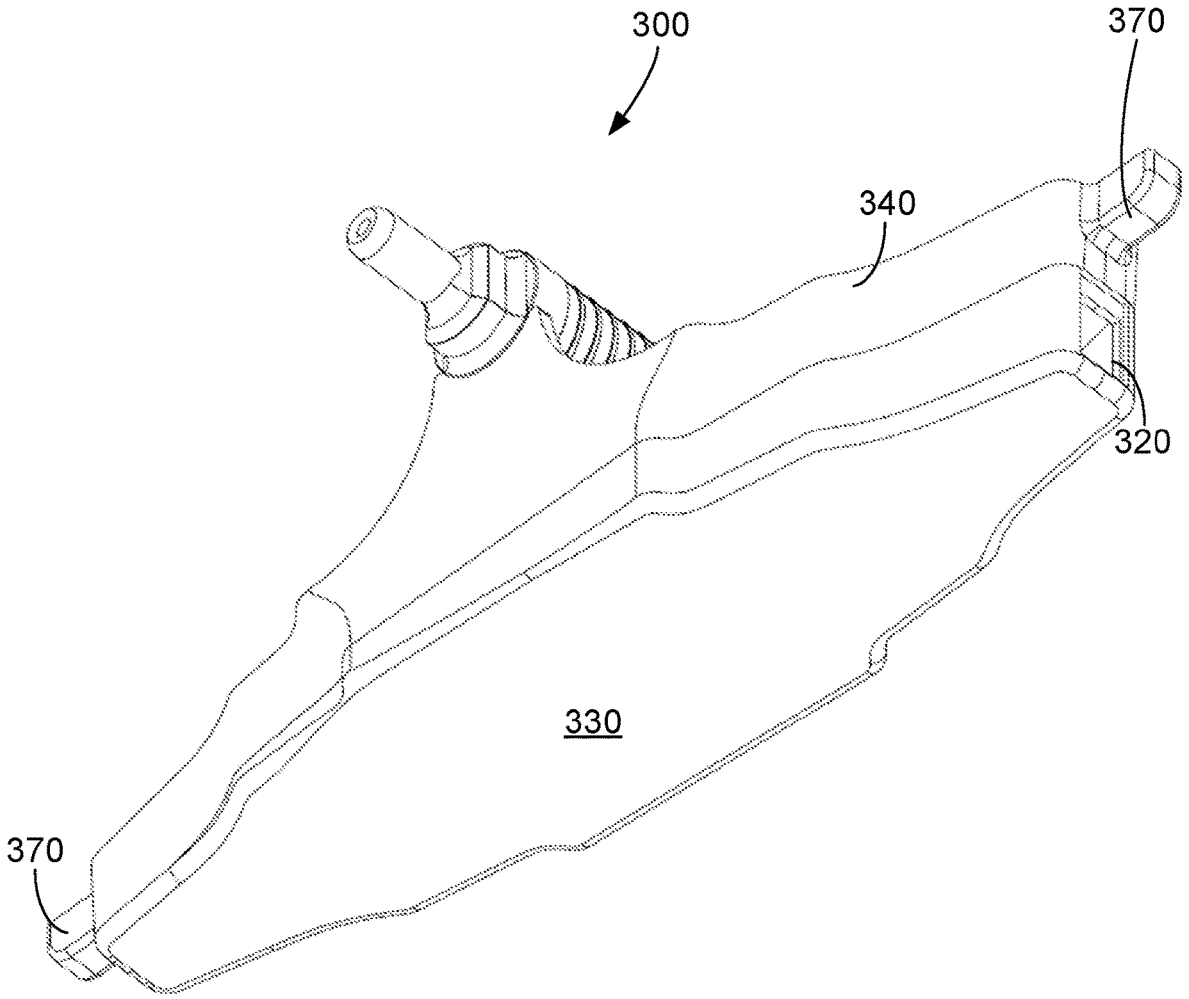
Figure 5C:
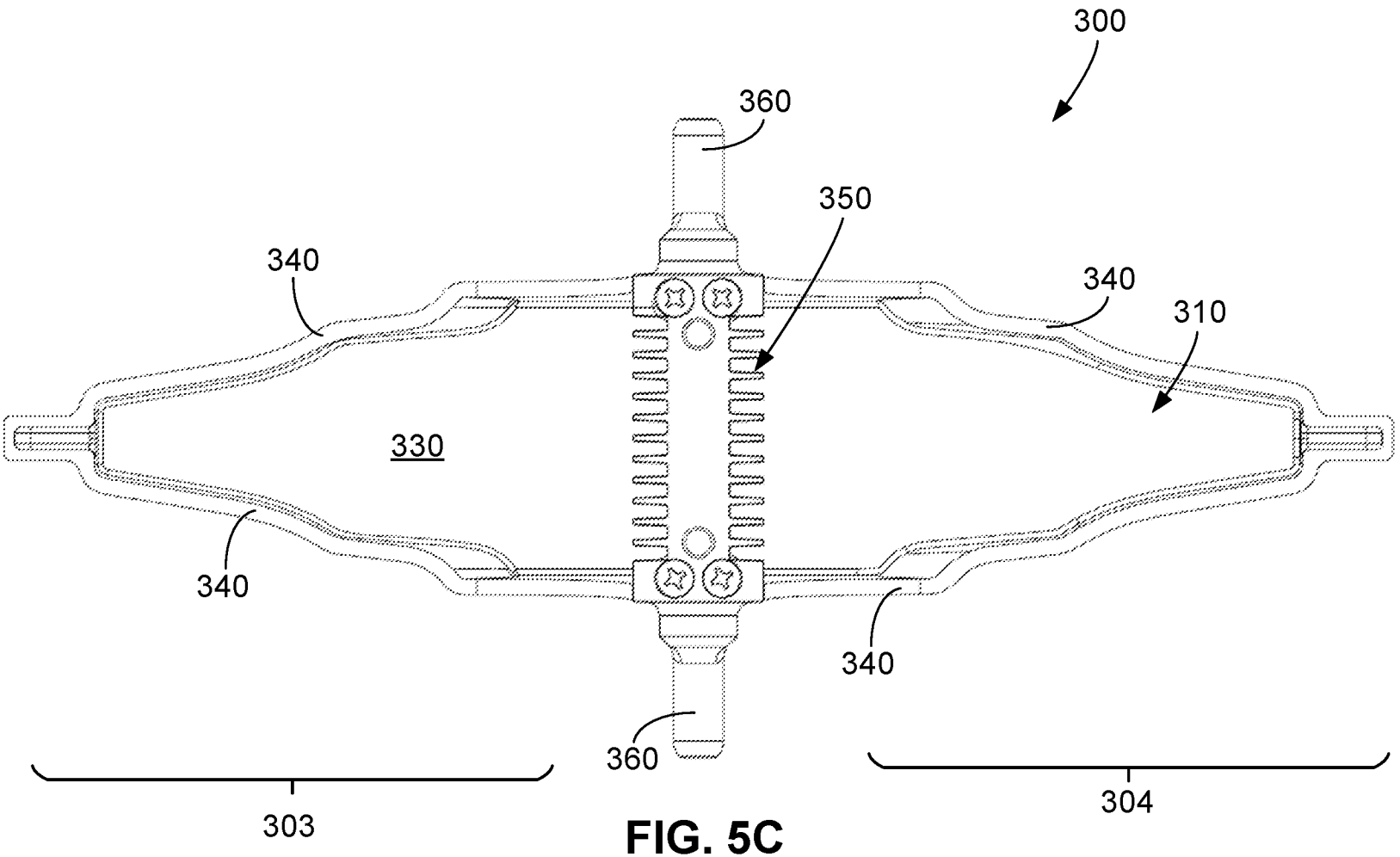
Figure 5D:
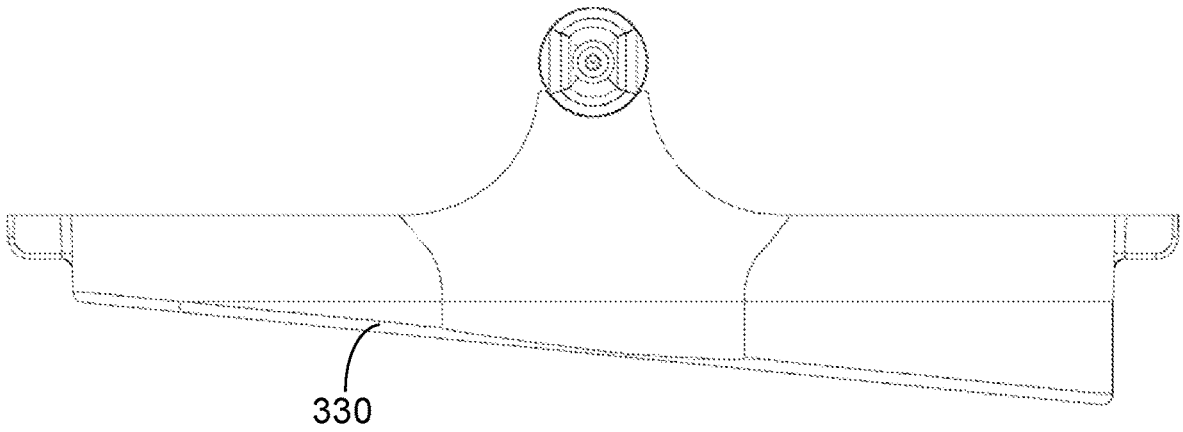
Figure 5E:
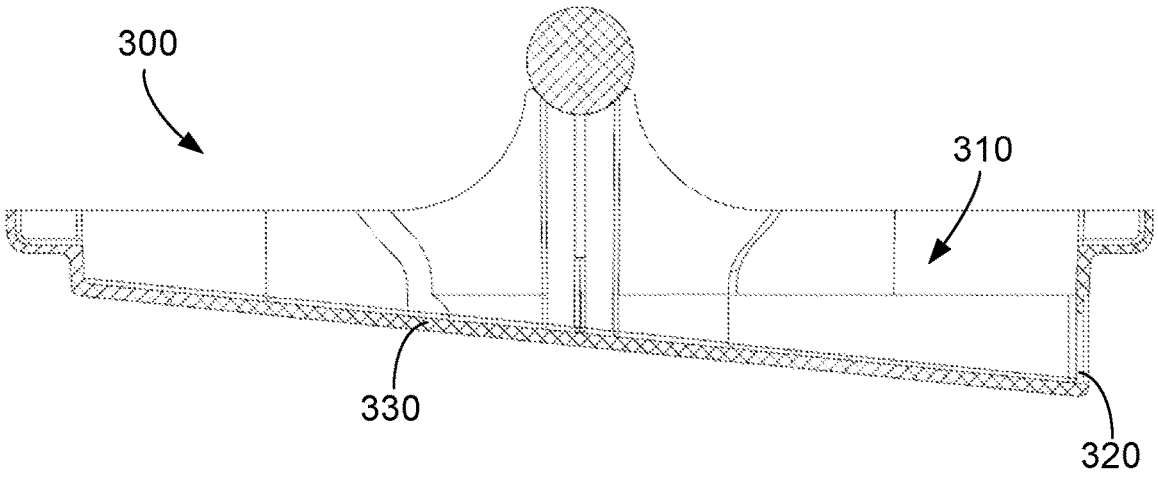

Referring to FIGS. 5A-5B and 5E, the aperture 320 is located along the lower portion 302 of the insert 300 and on the rearward portion 304 of the insert 300. The aperture 320 extends through a lateral wall 340 of the insert 300 in a longitudinal direction and spans a substantial part of the lower portion 302, e.g., at least 80% of the height of the lower portion 302. The aperture 320 has an overall height between 1 and 4 centimeters (e.g., between 1 and 2 centimeters, between 2 and 3 centimeters, between 3 and 4 centimeters, about 2 centimeters, about 3 centimeters, etc.). In the example shown in FIG. 5E, the aperture 320 extends vertically from the lower wall 330 to a portion of a lateral wall 340 of the insert 300, e.g., the rearmost lateral wall of the lateral walls 340. The aperture 320 extends over an area, e.g., an area of a vertical cross-section of the aperture 320, of about 1.5 and 12 square centimeters (e.g., between 1.5 and 6 square centimeters, between 4 and 9 square centimeters, between 7 and 12 square centimeters, about 3 square centimeters, about 5 square centimeters, about 7 square centimeters, about 9 square centimeters, etc.).

The aperture 320 is connected to the inner cavity 310, as discussed above. The aperture 320 extends horizontally through the rearmost lateral wall of the lateral walls 340 to bridge the inner cavity 310 and a space outside of the insert 300. The aperture 320 provides fluid communication between the inner cavity 310 of the insert 300 and the water on which the watercraft 100 is located. Further, when the insert 300 is mounted within the opening 120 of the watercraft 100, the aperture 320 is configured to extend to a location below the opening 120 of the watercraft 100.

Referring to FIGS. 5B-5E, the lower wall 330 extends from the forward portion 303 to the rearward portion 304 of the insert 300. The lower wall 330 at least partially defines the inner cavity 310, e.g., with the lateral walls 340. The lower wall 330 defines a lower surface 331 that similarly extends from the forward portion 303 to the rearward portion 304 of the insert 300. The surface 331 is angled relative to a longitudinal axis of the insert 300, e.g., relative to a longitudinal axis of and a forward direction of the watercraft 100, such that a forward portion of the surface 331 is above a rearward portion of the surface 331. An angle of the surface 331 relative to the longitudinal axis of the insert 300 is between 5 and 45 degrees (between 5 and 20 degrees, between 15 and 30 degrees, between 25 and 40 degrees, about 10 degrees, about 20 degrees, about 30 degrees, about 40 degrees, etc.). In the example depicted in FIGS. 5A-5E, the surface 331 is substantially planar such that the surface 331 extends linearly from the forward portion of the surface 331 to the rearward portion of the surface 331, although in other implementations, the surface 331 can be curved. As shown in FIG. 5E, the surface 331 extends longitudinally to the aperture 320.

The lateral walls 340 are a series of interconnected walls defining lateral surfaces of the insert 300. One or more of the lateral walls 340 extend vertically from the lower wall 330. For example, the lateral walls 340 can include a forward lateral wall, a left lateral wall, a right lateral wall, and a rearward lateral wall, with the aperture 320 being defined in the rearward lateral wall. The forward, left, and right lateral walls extend vertically from the lower portion 302 of the insert 300 to the upper portion 301 of the insert 300, thereby preventing fluid communication across these lateral walls. In contrast, the aperture 320 extends from the lower wall 330 and through a portion of the rearward lateral wall, thus providing fluid communication across the rearward lateral wall. In this regard, the aperture 320 in combination with the forward, left, and right lateral walls extend along an entirety of a perimeter of the lower wall 330. The lateral walls 340 at least partially define the inner cavity 310, e.g., with the lower wall 330, and extend along an outer perimeter of the lower wall 330, e.g., an outer perimeter of the surface 331.

Referring to FIGS. 5A and 5C, the handle 350 and the shafts 360 are located along a transverse central axis of the insert 300. The shafts 360 can be part of an elongate member extending along the transverse central axis, across a width of the portion of the insert 300 defined by the lateral walls 340 and the lower wall 330. This elongate member can be fixed to the handle 350, e.g., via fasteners. The handle 350 is manually graspable by a user of the watercraft 100, thus providing an easy mechanism for the user to place the insert 300 into the opening 120 of the watercraft 100 and to remove the insert 300 from the opening 120. The handle 350 can similarly extend along the transverse central axis of the insert 300. Further, the handle 350 is positioned above the inner cavity 310 to provide sufficient space for the user's hand to grasp around an entirety of the handle 350. The handle 350 can extend from the left shaft to the right shaft of the shafts 360. The left shaft is on a left side portion of the insert 300, while the right shaft is on a right side portion of the insert 300. In addition, the shafts 360 protrude radially outwardly away from a center of the insert 300, and further protrude radially outwardly away from the lateral walls 340 of the insert 300.

Figure 6:
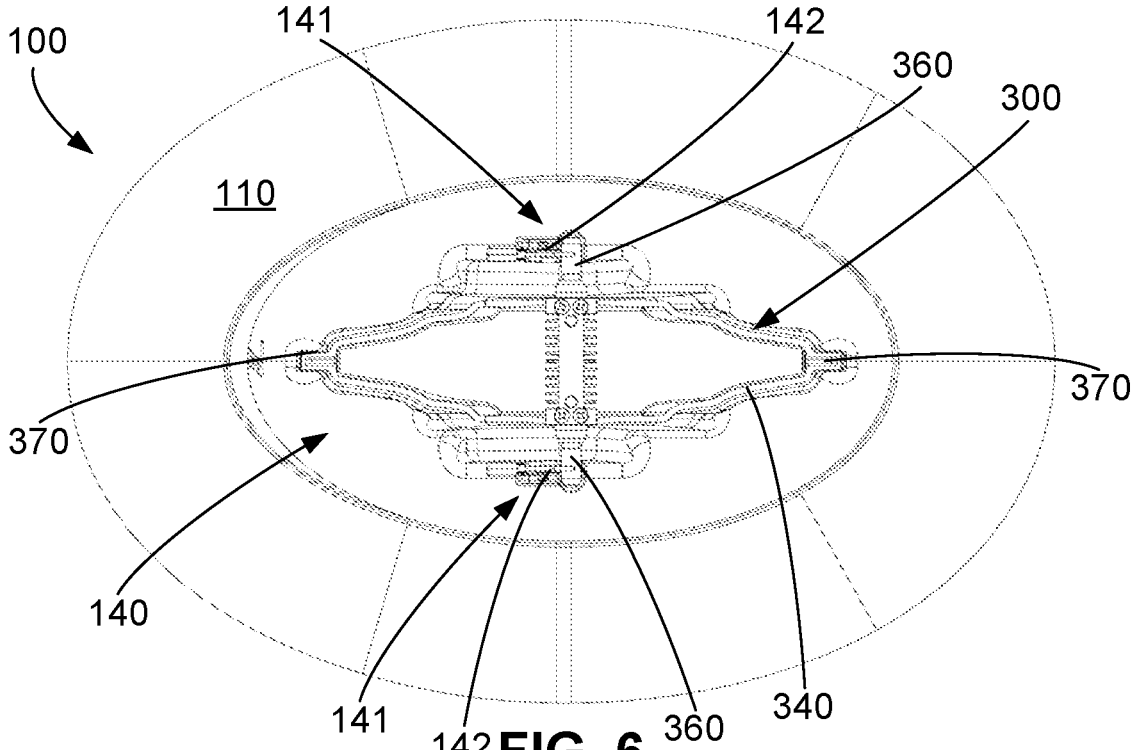
FIGS. 6 and 7 are top views of a portion of a watercraft that receives a removable insert for draining water, with FIG. 6 showing the removable insert received in the portion of the watercraft and FIG. 7 showing the portion of the watercraft without the removable insert.
Figure 7:
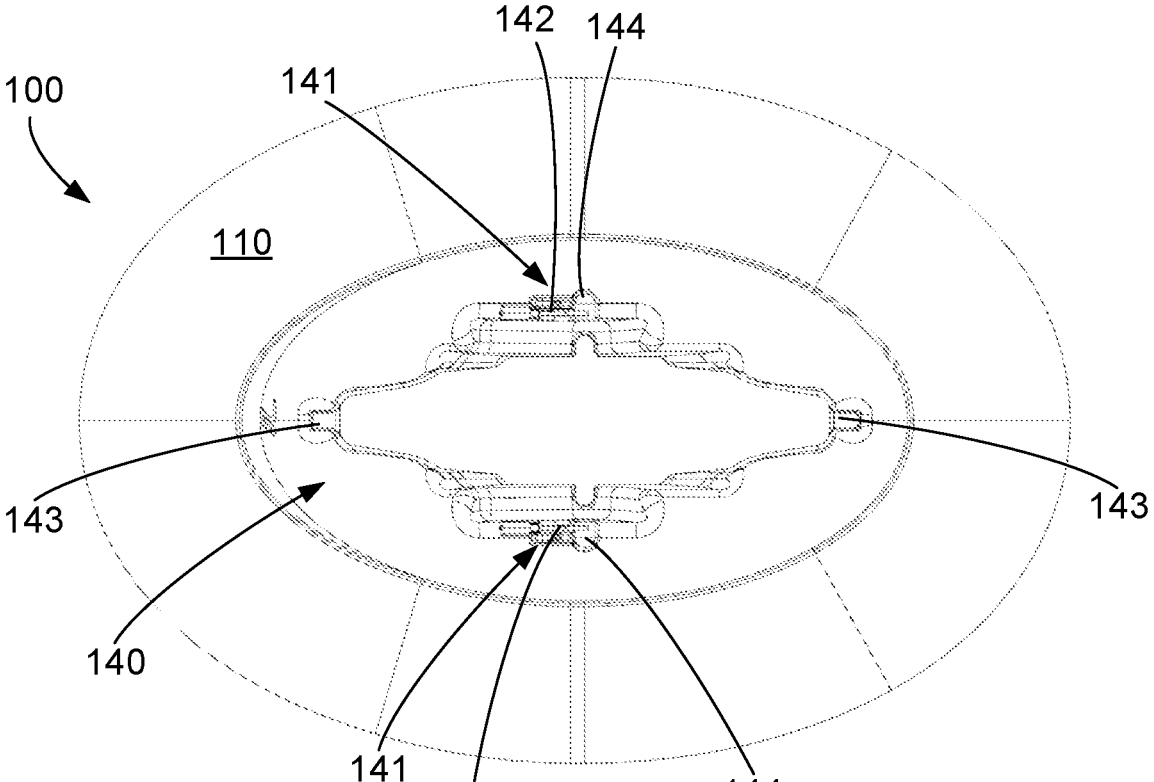

FIGS. 6 and 7 illustrate an interface between the watercraft 100 and the insert 300, specifically an interface between the support assembly 140 of the watercraft 100 and bearing surfaces of the insert 300. When the insert 300 is received within the opening 120 of the watercraft 100, the lateral walls 340 extend along at least part of a perimeter of the opening 120 of the watercraft 100. The insert 300, referring briefly back to FIGS. 5B, includes bearing surfaces on the shafts 360 and the longitudinal support members 370. The longitudinal support members 370 are positioned along a longitudinal central axis of the insert 300. The longitudinal support members 370 provide downward facing bearing surfaces that rest on corresponding longitudinal support surfaces 143 (forward and rearward bearing surfaces 143 shown in FIG. 7) on the support assembly 140. The shafts 360 also provide bearing surfaces that can rest on corresponding side support surfaces 144 (left and right side support surfaces 144 shown in FIG. 7) on the support assembly 140. The longitudinal support surfaces 143 and the side support surfaces 144 are located within the opening 120 of the watercraft 100.

In implementations, the support assembly 140 can include the structure for defining the bearing and support surfaces 143, 144 and the structure for the locking assembly 141. For example, in implementations in which the support assembly 140 is an assembly separate from the watercraft 100, the structure for defining the bearing and support surfaces 143, 144 can be formed of one or more components that are then mounted to the watercraft 100, e.g., attached to the watercraft. In implementations in which the support assembly 140 is integral to the watercraft 100, the structure for defining the bearing and support surfaces 143, 144 can be formed as part of the hull 110 of the watercraft 100. For example, the hull 110 and the structure for defining the bearing and the support surfaces 143, 144 can be formed in a process that forms a monolithic component including the hull 110 and this structure, e.g., a molding, inflatable, or thermoforming process.

As shown in FIG. 6, the locking assembly 141 can engage with the shafts 360 of the insert 300 to lock the insert 300 to the watercraft 100. In particular, the locking arms 142 of the locking assembly 141 can engage the shafts 360 and prevent the shafts from being removed from the opening 120, e.g., in a vertical direction. The locking arms 142 can be manually manipulated by a user to release the insert 300 and thereby allow the user to pull the insert 300 out of the opening 120.

Figure 8:
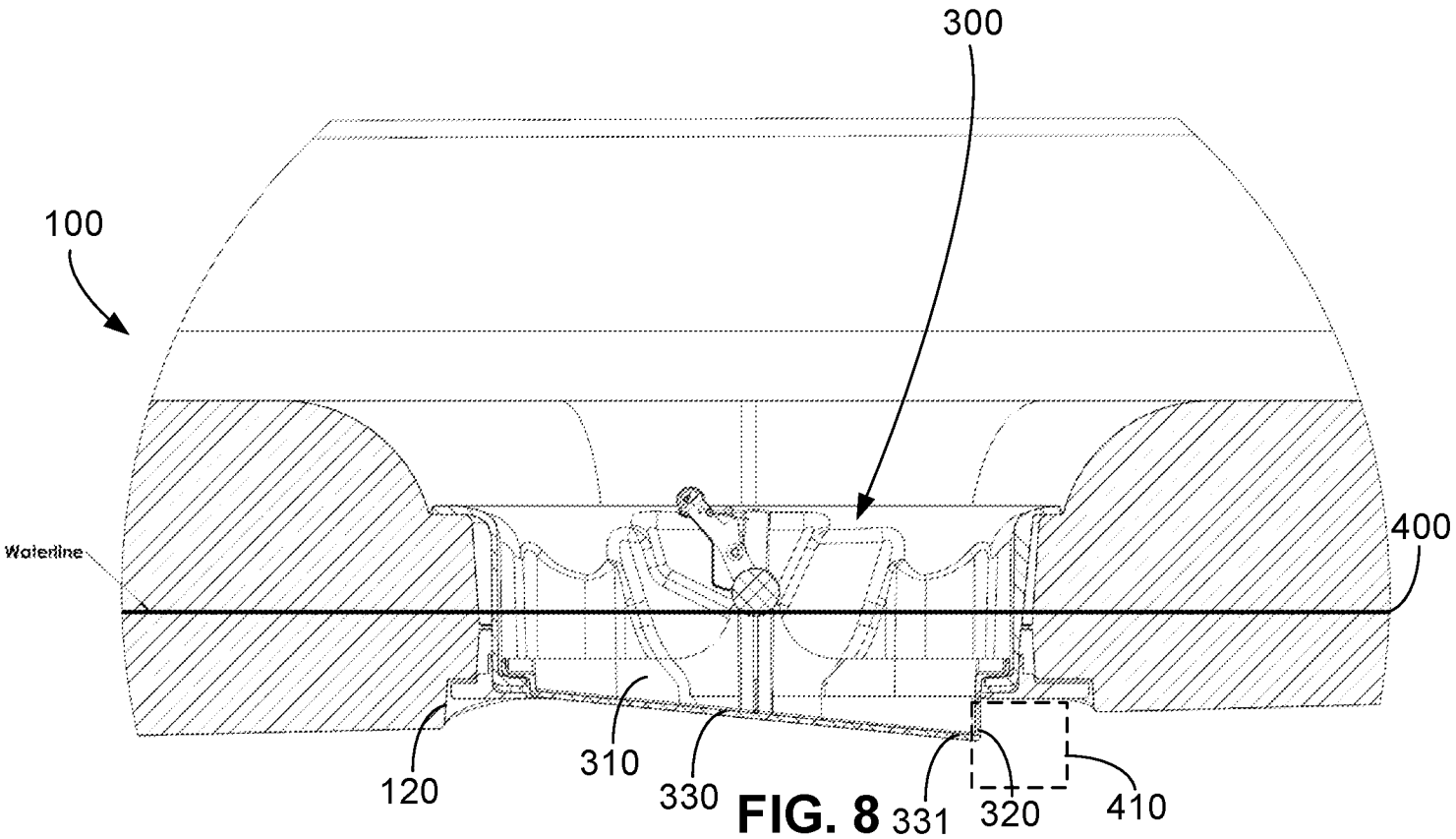
FIG. 8 is a side cross-sectional view of the portion of the watercraft through the section line A-A in FIG. 3, with a possible waterline schematically depicted.

FIG. 8 illustrates a schematic example of the watercraft 100 when the watercraft 100 is positioned on a body of water having a waterline 400 (e.g., an upper surface of the body of water). The watercraft 100 is configured such that the waterline 400 is positioned above the aperture 320 and above the inner cavity 310 when the insert 300 is removably inserted into the opening 120.

In use, the insert 300 can encourage drainage of water through the aperture 320 out of the inner cavity 310. As discussed in this disclosure, when the watercraft 100 is positioned on the body of water, the aperture 320 is at least partially submerged in the water and can fluid communication between the inner cavity 310 of the insert 300 and the body of water.

Particularly, as the watercraft 100 travels along the surface of the body of water, water can splash onto or otherwise flow through the aperture 320.

The forward travel of the watercraft 100 can create a zone 410 of low fluid pressure proximate to the aperture 320 due to the Venturi effect caused by the shape and dimension of the lower surface 331 of the insert 300. The lower wall 330 is shaped and dimensioned such that a first pressure within the inner cavity 310, e.g., a first fluid pressure within the inner cavity 310, is greater than a second pressure at the aperture 320, e.g., a second fluid pressure within the inner cavity 310, as the watercraft 100 travels in a forward direction. For example, with the angle of the lower surface 331, the forward portion of the lower surface 331 is positioned above the rearward portion of the lower surface 331, thus reducing fluid pressure at the rearward portion as the watercraft 100 travels in the forward direction. If the aperture 320 is located at a first location in the body of water along a longitudinal axis of the insert 300, or a longitudinal axis of the watercraft 100, a pressure at a second location proximate to the lower wall 330 in the body of water is greater than a pressure at the first location. This first location is located along the rearward portion 304 (FIG. 5A) of the insert 300, the second location is located along the forward portion 303 (FIG. 5A) of the insert 300.

In examples in which some water from the body of water has intruded into the inner cavity 310 as the watercraft 100 is traveling in the forward direction, the movement of the watercraft 100 in the forward direction can further limit accumulation of water in the inner cavity 310 and can also drain the water accumulated within the inner cavity due to pressure differential between the fluid in the inner cavity 310 and the fluid in the low-pressure zone 410 of the body of water proximate to the aperture 320. In implementations, the watercraft 100 travels in the forward direction at a speed between 2.5 and 20 meters per second (e.g., between 2.5 and 15 meters per second, between 5 and 17.5 meters per second, between 7.5 and 20 meters per second, about 5 meters per second, about 10 meters per second, about 15 meters per second, etc.). At least at such speeds, the lower surface 331 of the insert 300 can reduce pressure in the low-pressure zone 410 near the aperture 320 sufficiently to cause drainage of water from the inner cavity 310 back into the body of water. Further, at such speeds, the lower surface 331 creates a difference between pressure within the inner cavity 310 and pressure in the low-pressure zone 410 that is 6,250 to 400,000 MPa.

The insert 300 can be useful in situations where the watercraft 100 is being propelled with a propulsion mechanism that is separate from a removable propulsion mechanism (e.g., the removable propulsion mechanism 200 shown in FIG. 2) that is received within the opening 120. In particular, this propulsion mechanism could correspond to the outboard motor system 170. The outboard motor system 170 could be operated to propel the watercraft 100 at speeds that could cause water to flow through the opening 120 of the watercraft 100 onto the hull 110, if the insert 300 were not present. With the insert 300, the forward movement of the watercraft 100 can drain water at a rate sufficient to ensure that water does not flow onto the hull 110. I In another example, a user may wish to remove the removable propulsion mechanism and use the outboard motor 170 for propelling the watercraft 100 across the water. A user may prefer to use the removable propulsion mechanism for traveling across relatively short distances (e.g., less than 100 meters, less than 200 meters, less than 300 meters, less than 400 meters, less than 500 meters, etc.) while performing tasks in a particular area (e.g., recreation, fishing, or other task that could be limited to a small area). The user may prefer to use the outboard motor system 170 for traveling longer distances (e.g., more than 100 meters, more than 200 meters, more than 300 meters, more than 400 meters, more than 500 meters, etc.) at higher speeds. The user may remove the removable propulsion mechanism to reduce drag on the watercraft 100 as the watercraft 100 travels in the forward direction under the propulsion of the outboard motor system 170. If the removable propulsion mechanism were kept mounted within the opening 120, the movement of the watercraft 100 could result in water intruding onto the hull 110 of the watercraft 100 through the removable propulsion mechanism.

A number of implementations have been described. While this specification contains many specific implementation details, these should not be construed as limitations on the scope of what is being claimed, which is defined by the claims themselves, but rather as descriptions of features that may be specific to particular implementations of particular inventions. It will be understood that various modifications may be made.

Figure 9:
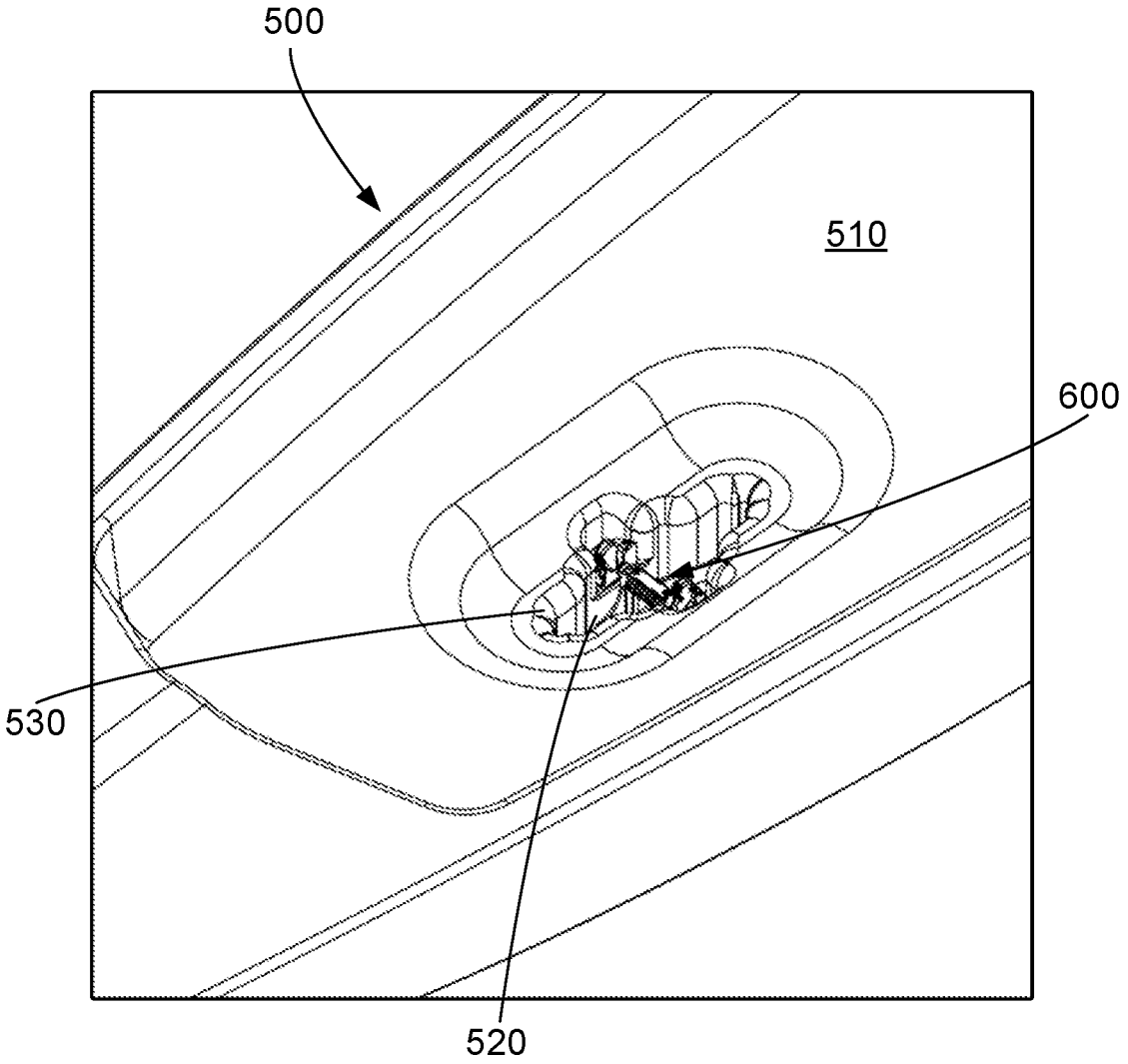
FIG. 9 is a top perspective view of a portion of a watercraft with a support assembly and a removable insert mounted to the support assembly.

The support assembly 140 for supporting modular assemblies and mounting modular assemblies to the watercraft 100 can vary in implementations as described herein. In some implementations, the support assembly 140 is integral to the watercraft 100 while in other implementations, the support assembly 140 is separate from the watercraft 100. FIG. 9 illustrates an example of a portion of a watercraft 500 including a hull 510, an opening 520, and a support assembly 530 that is integral to the watercraft 500, and an insert 600. The bearing and support surfaces (e.g., similar to the bearing and support surfaces 143, 144 discussed with respect to FIGS. 6-7) are surfaces on the hull 510, rather than surfaces on a separate component mounted to the hull 510. Further, the bearing and support surfaces are located within the opening 520 and are configured to support the insert 600 within the opening 520 of the watercraft 500.

Other implementations with variations in the structure and design of the support assembly 140 are possible. For example, a support assembly can be formed of multiple interconnected components. In implementations in which the support assembly is separate from the watercraft 100, the support assembly can be mounted to the hull of the watercraft in a number of ways, including via fasteners, adhesives, or other methods.

The watercraft 100 shown in FIGS. 1-3 is a personal kayak. The type of watercraft that can benefit from inserts similar to those discussed in this disclosure can vary in implementations. For example, the watercraft can be a kayak for a single passenger, a tandem kayak for multiple passengers, a fishing kayak, a raft, a dinghy, an inflatable kayak, a pontoon, or another watercraft. In particular, the watercraft can include an opening for receiving a modular assembly for a propulsion mechanism, a data collection apparatus (e.g., a sonar device), or other device that can be received in the opening and that interfaces with the body of water.

Figure 10:
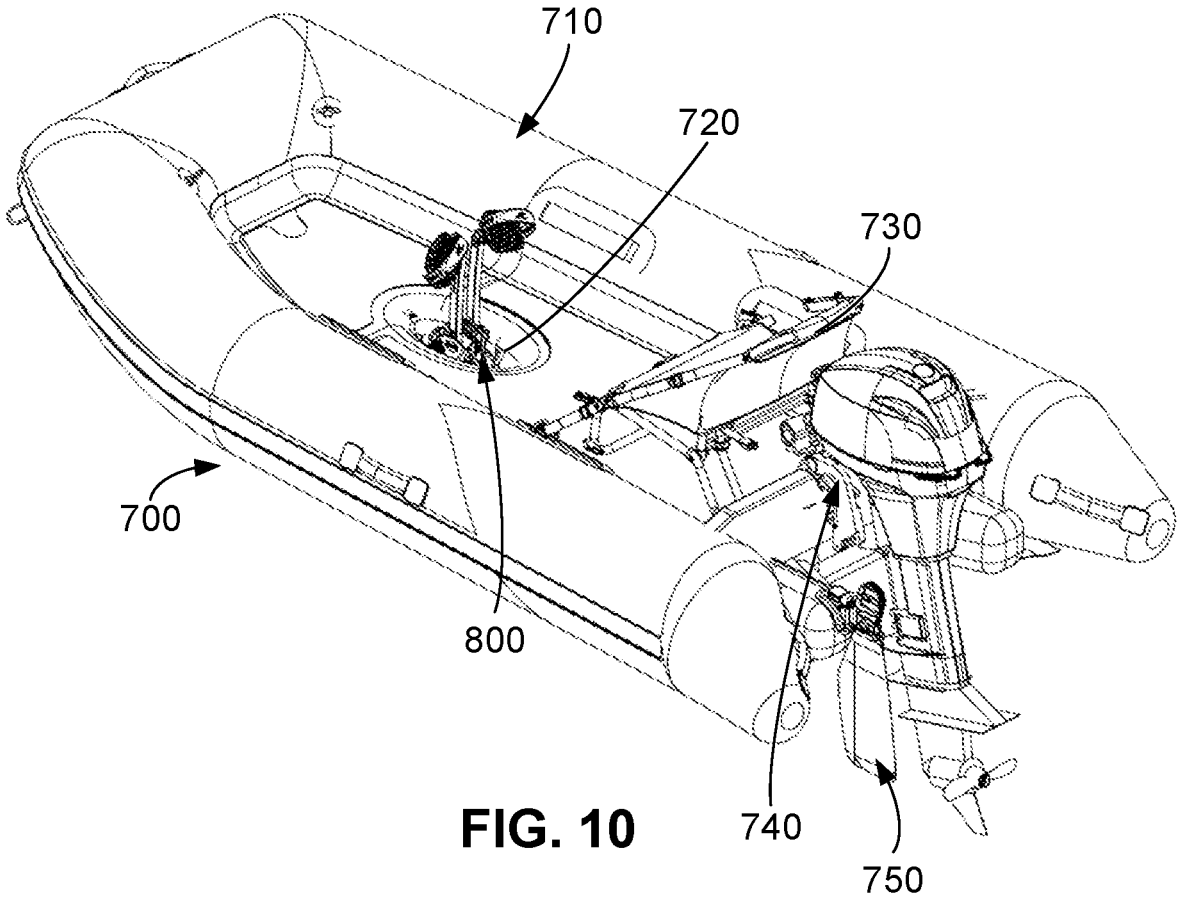
FIG. 10 is a top perspective view of another example of a watercraft with a removable propulsion mechanism.
Figure 11A:
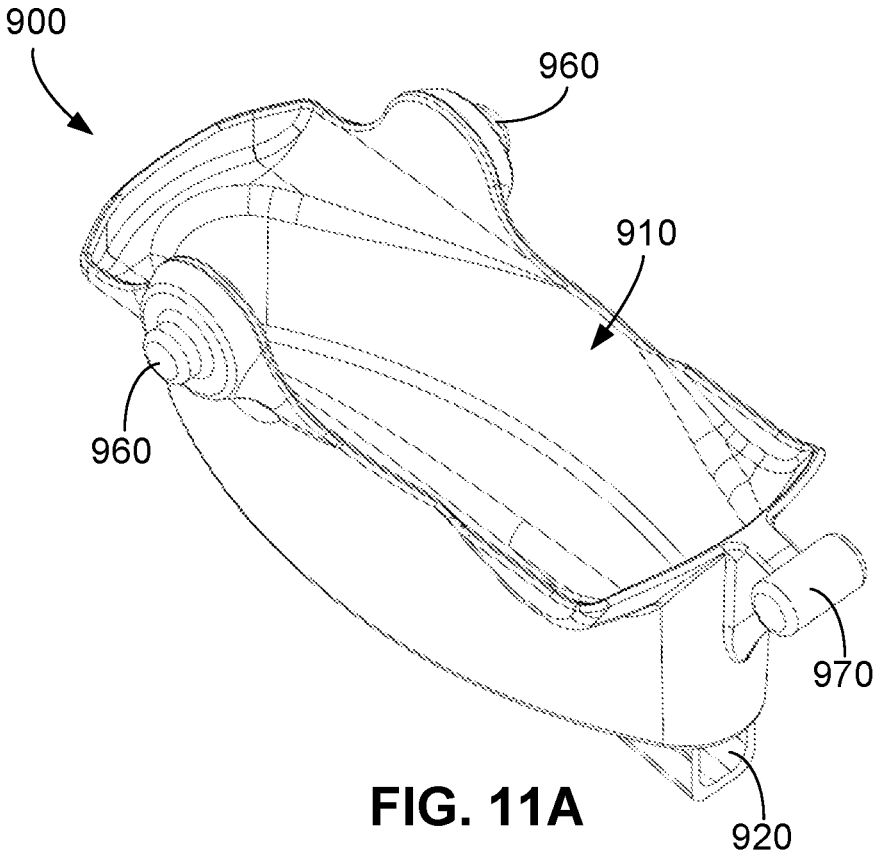
FIGS. 11A-11D are top-rear perspective, bottom-front perspective, top, and side cross-sectional views of another example of a removable insert for draining water.
Figure 11B:
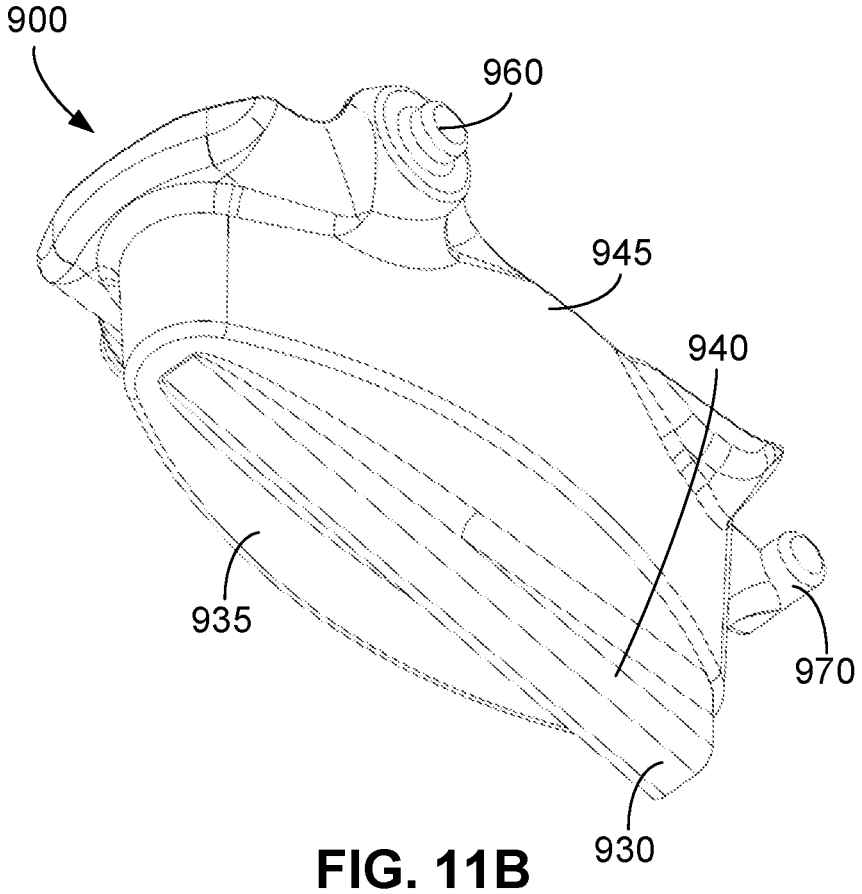
Figure 11C:
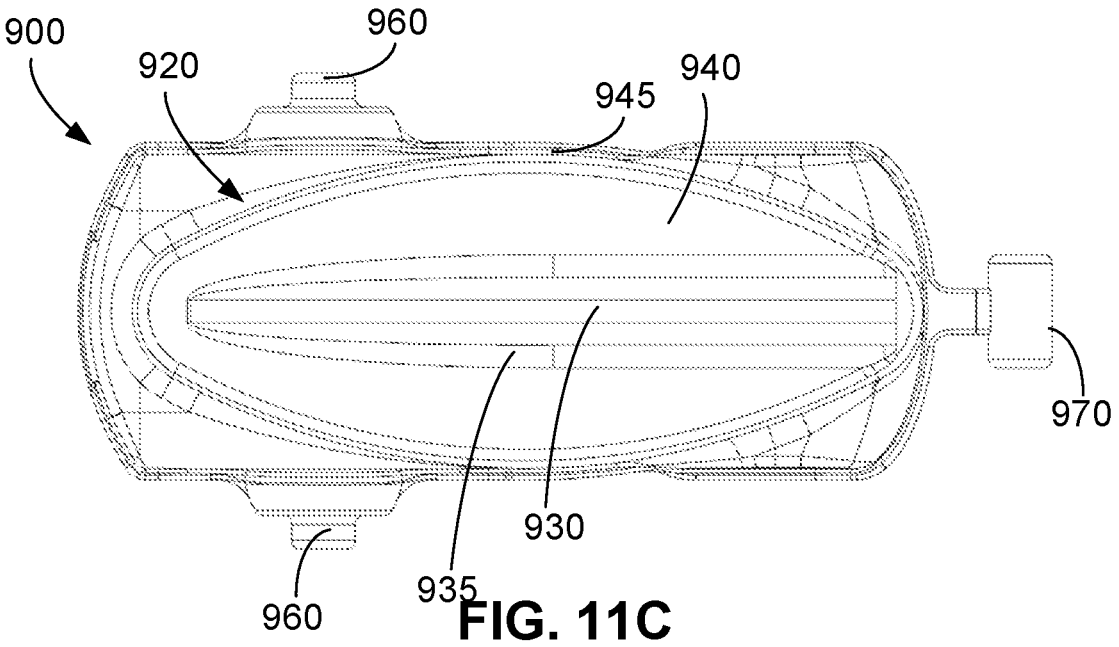
Figure 11D:
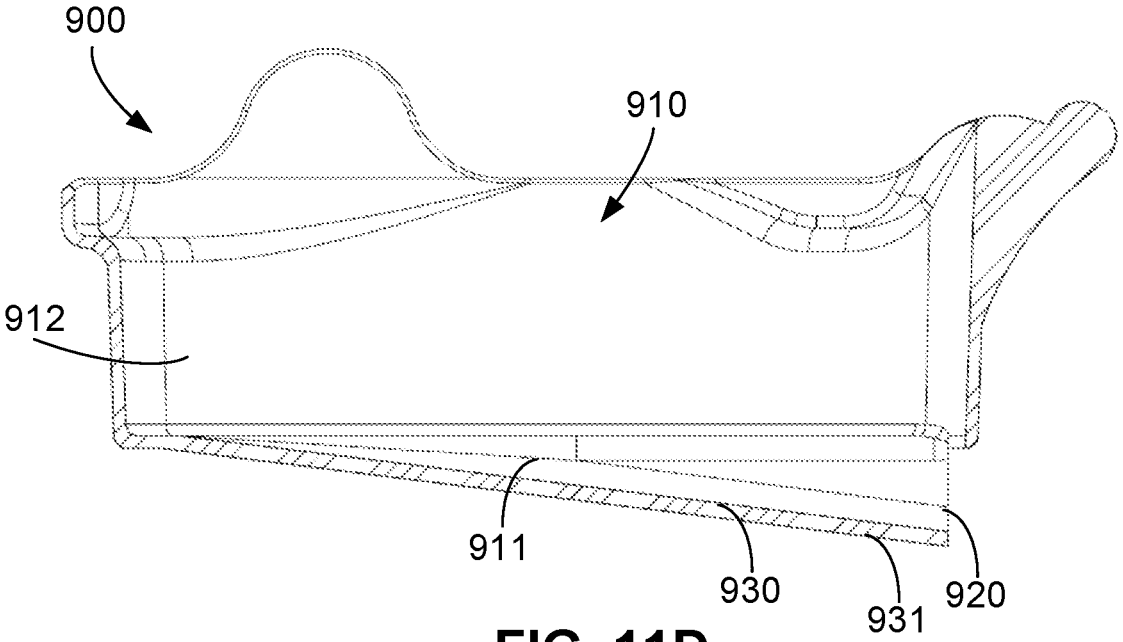

Referring to FIG. 10, in another exemplary implementation, a watercraft 700 is a dinghy that differs from the watercraft 100 in the structure and design of the hull 710 of the watercraft 700. The watercraft 700 can be wider than the watercraft 100. In some implementations, the watercraft 700 can be suitable for multiple passengers. Like the watercraft 100, the watercraft 700 includes an opening 720 (similar to the opening 120 for receiving modular assemblies), a chair 730 (similar to the chair 130), an outboard motor system 740 (similar to the outboard motor system 170), and a rudder mechanism 750 (similar to the rudder mechanism 150). In the example shown in FIG. 10, the opening 720 receives a removable propulsion mechanism 800. This opening 720 is similarly configured to receive an insert similar to the insert 300 described with respect to FIGS. 1-8, or other implementations of inserts described in this disclosure.

While the watercraft 100 of FIGS. 1-3 is described as having a pedal-driven system in the form of the removable propulsion mechanism, other removable propulsion mechanisms can be present in implementations. For example, the propulsion mechanism can include foot pedals, hand cranks, or other manually driven propulsion mechanisms.

The design and form factor of inserts may also vary in implementations. For example, lateral walls of the inserts need not extend along a perimeter of the lower wall of the insert that defines the sloped lower surface. Further, the bearing surfaces of the insert that are supported by the support assembly of the watercraft need not be positioned along a central longitudinal axis or a central transverse axis of the insert.

For example, referring to FIGS. 11A-11D, an insert 900 is similar in function to the insert 300 in that the insert 900 can be easily placed within an opening of a watercraft that is configured to receive various modular assemblies. The insert 900 differs from the insert 300 in a number of ways.

For example, the insert 900 includes an inner cavity 910 with a narrower first portion 911 adjoining an aperture 920 of the insert 900 and a wider second portion 912 adjoining the narrower first portion 911. A lower wall 930 of the insert 900 is similar to the lower wall 330 in that the lower wall 930 defines a sloped lower surface 931 similar to the lower surface 331. The lower wall 930 at least partially defines the narrower first portion 911 of the inner cavity 910. The insert 900 further includes another lower wall 935 that is not sloped and that partially defines the wider second portion 912 of the inner cavity 910. A first set of lateral walls 940 at least partially defines the narrower first portion 911 of the inner cavity 910, and a second set of lateral wall 945 at least partially defines the wider second portion 912 of the inner cavity 910. The narrower first portion 911 can further obstruct water from flowing into the inner cavity 910.

Figure 12:
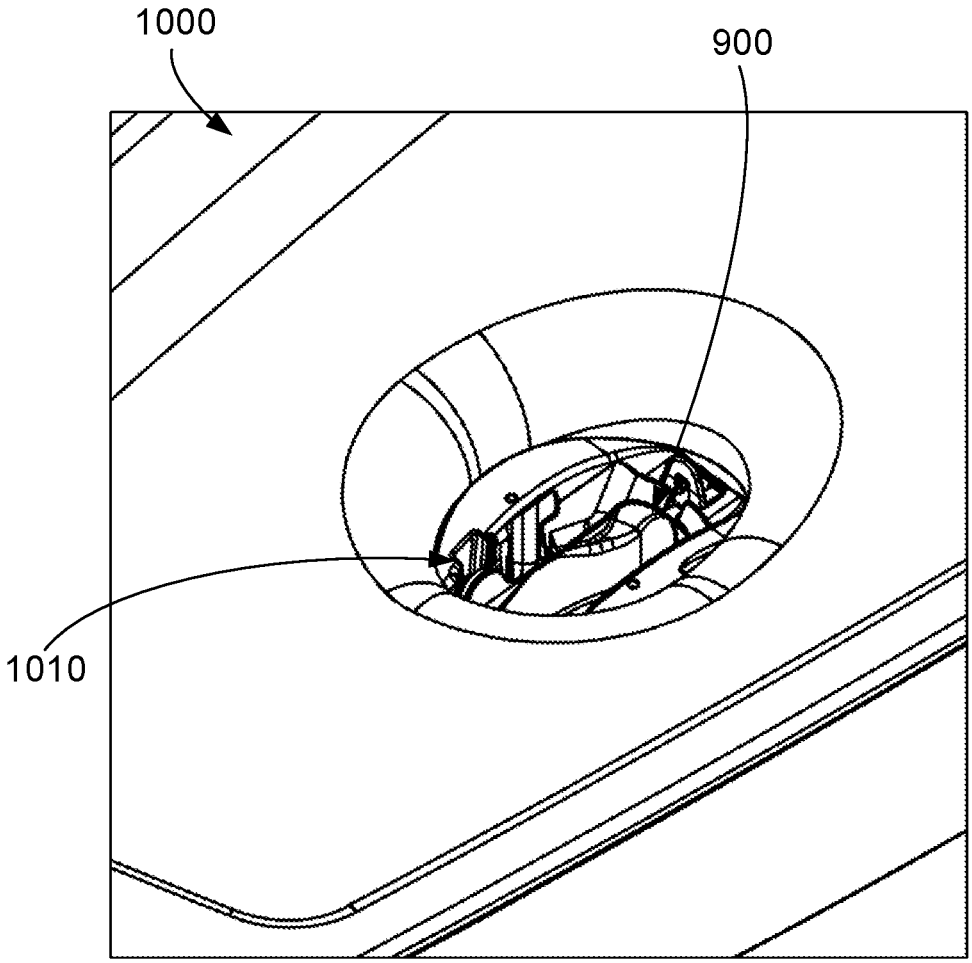
FIG. 12 is a top perspective view of a portion of a watercraft with a support assembly in which the insert of FIGS. 11A-11D is inserted.
Figure 13A:
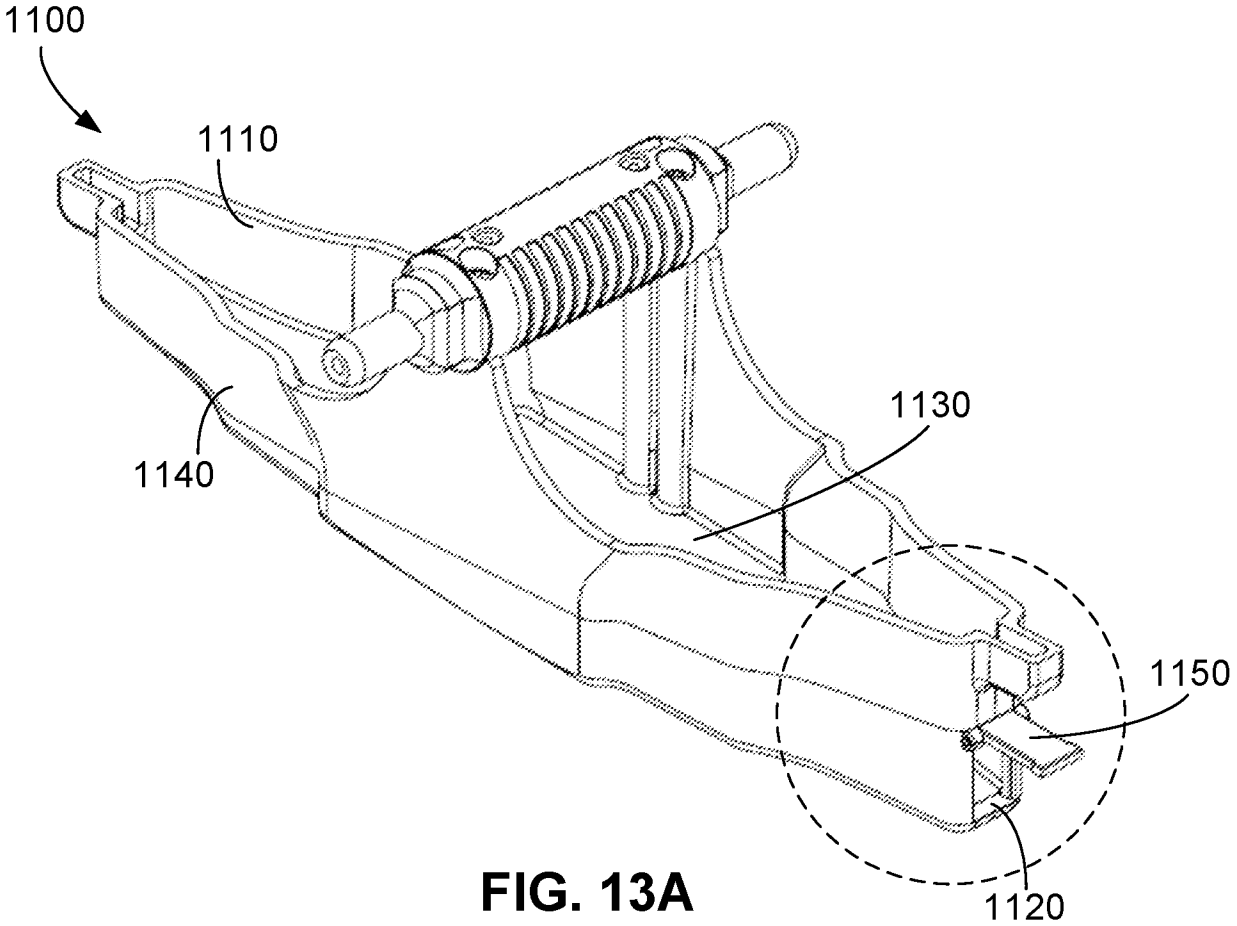
FIG. 13A is a rear perspective view of another example of a removable insert, with a flap of the insert in an open position.
Figure 13B:
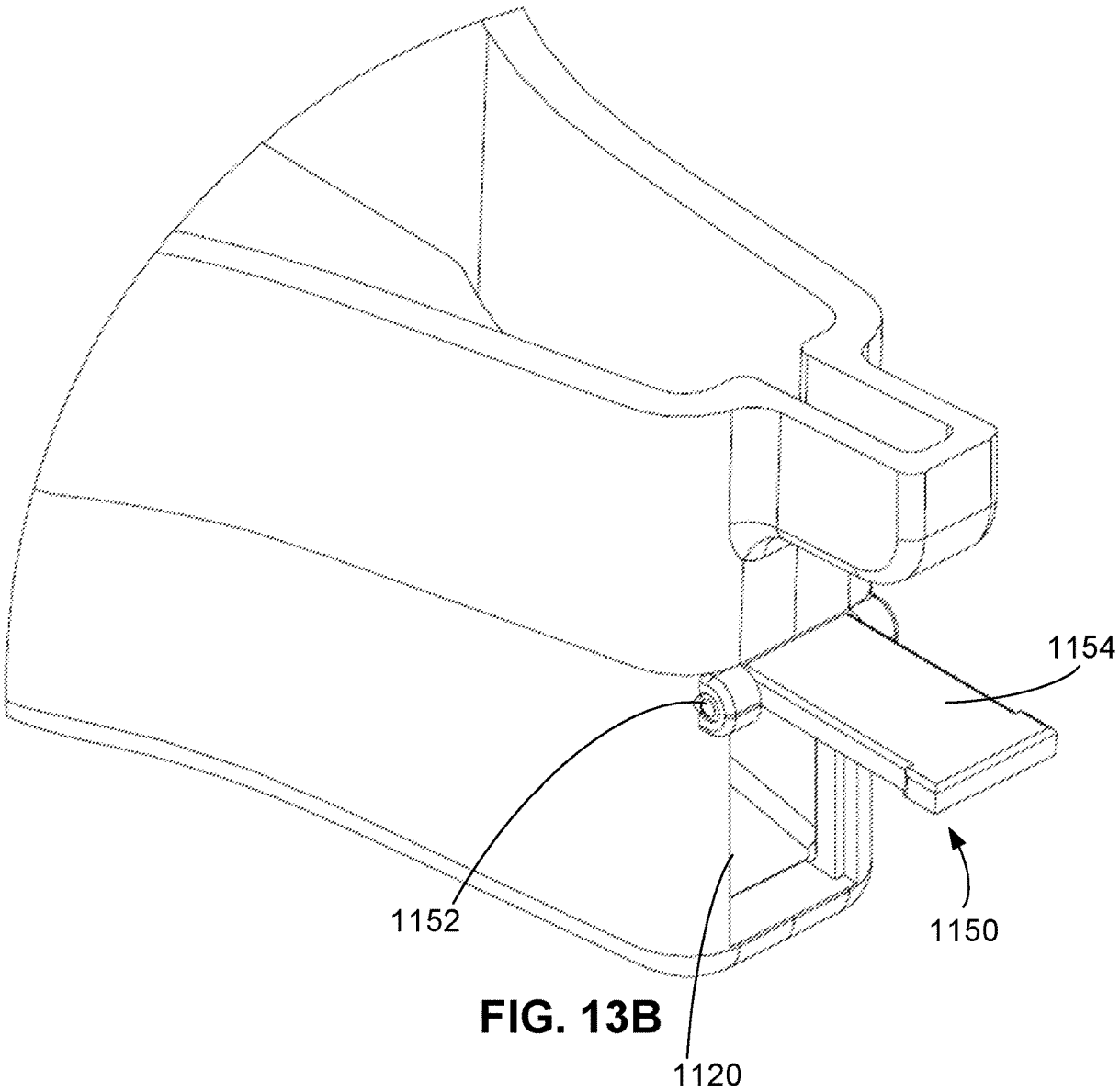
FIG. 13B is an enlarged rear perspective view of a portion of the removable insert of FIG. 13A.

The insert 900 also differs from the insert 300 in that shafts 960 of the insert 900 are located forward of a central transverse axis of the insert 300, and longitudinal support members 970 of the insert 900 differ in form from the longitudinal support member 370 of the insert 300. To accommodate for this difference, referring to the portion of a watercraft 1000 shown in FIG. 12, a support assembly 1010 of the watercraft 1000 can have bearing surfaces at corresponding locations to support the longitudinal support members 970 and the shafts 960.

Figure 14A:
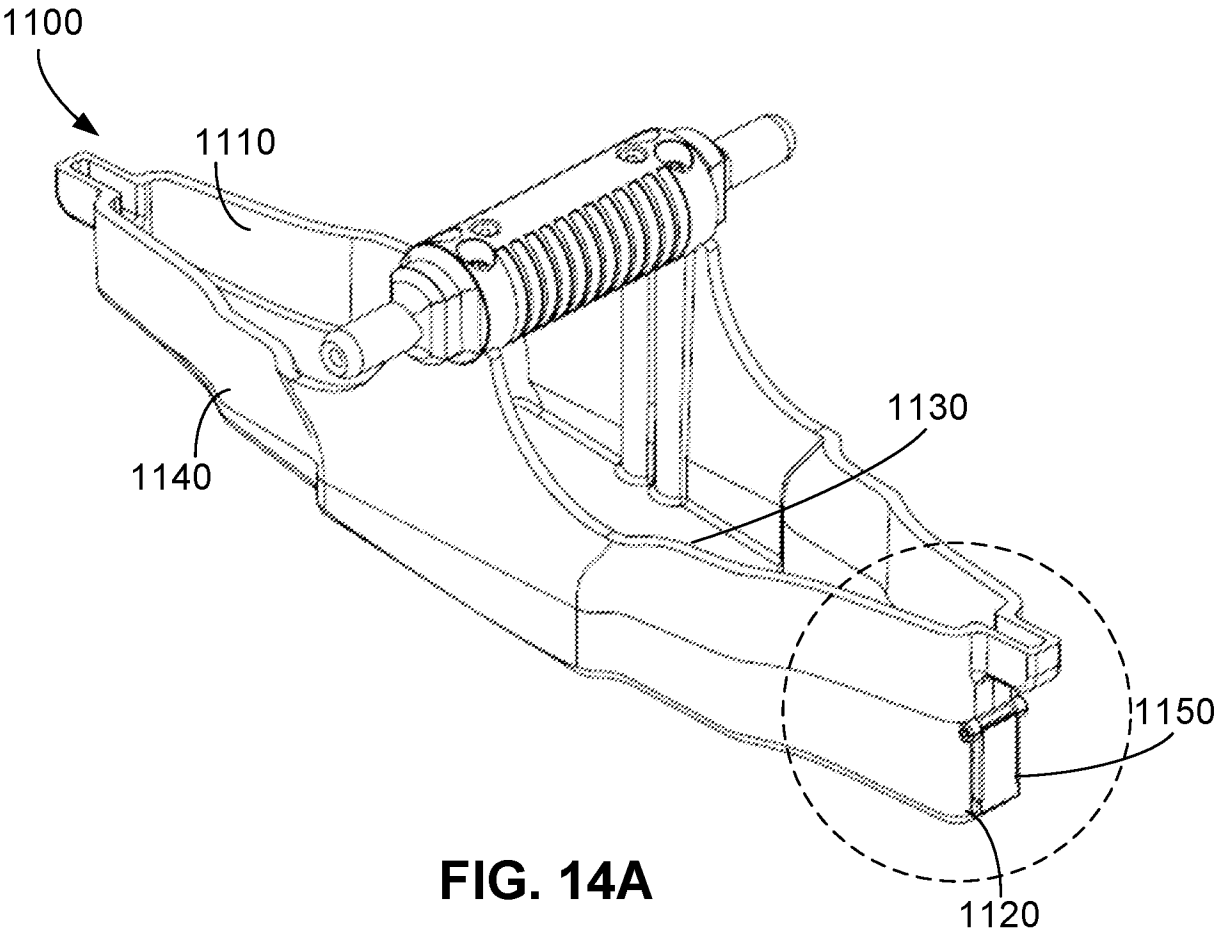
FIG. 14A is a rear perspective view of the removable insert of FIG. 13A, with the flap of the insert in a closed position.
Figure 14B:
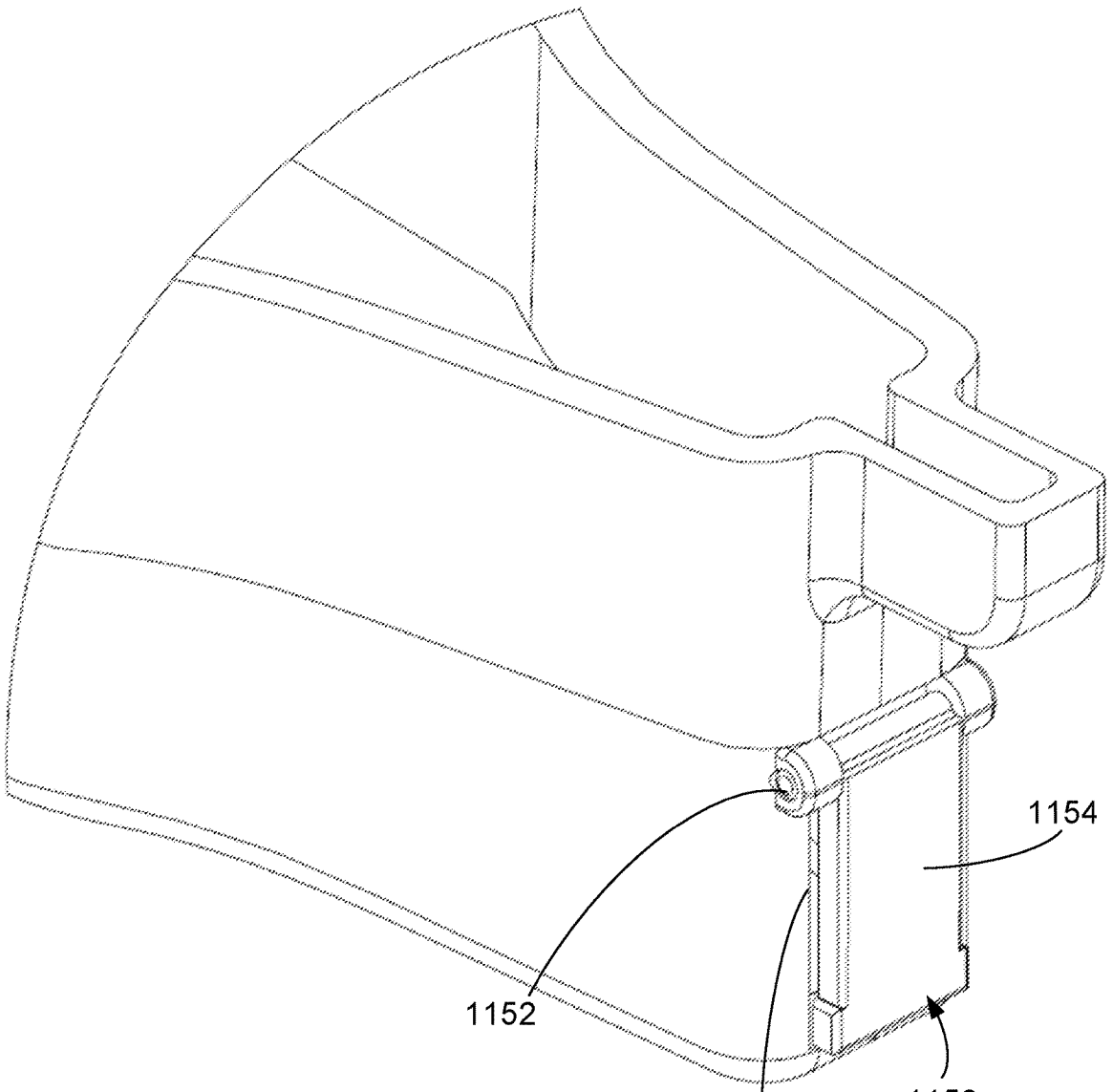
FIG. 14B is an enlarged rear perspective view of the portion of the removable insert of FIG. 14A.

FIGS. 13A-14B illustrate another example of a removable insert 1100. The insert 1100 includes an inner cavity 1110, an aperture 1120, a lower wall 1130, and lateral walls 1140 similar to the inner cavity 310, the aperture 320, the lower wall 330, and the lateral walls 340 of the insert 300. The removable insert 1100 differs from the insert 300 in that the insert 1100 includes a flap 1150 that is adjacent to the aperture 1120 and that is movable between an open position (FIGS. 13A-13B) and a closed position (FIGS. 14A-14B). The flap 1150 is movably mounted, e.g., hingedly and/or pivotally mounted, to a rearward lateral wall of the lateral walls 1140 of the insert 1100. An upper edge of the flap 1150 is movably attached to the rearward lateral wall. The flap 1150 is sized and dimensioned to cover an entirety of the aperture 1120 and to seal the inner cavity 1110 from the body of water to prevent fluid from flowing into the inner cavity 1110. The flap 1150 is rotatable about a shaft 1152 that mounts the flap 1150 to the rearward lateral wall of the lateral wall 1150. The flap 1150 extends downwardly from the shaft 1152 to cover the aperture 1120.

The flap 1150 is configured such that the flap 1150 is in the closed position (FIGS. 14A-14B) when a watercraft to which the insert 1100 is mounted is moving in a forward direction and such that the flap 1150 is in the open position (FIGS. 13A-13B) when the watercraft is moving in a rearward direction. A neutral position of the flap 1150 can be the closed position (FIGS. 14A-14B). When the watercraft is positioned on a body of water and moving in the forward direction, a significant difference between fluid pressure in the inner cavity 1110 and fluid pressure on a surface 1154 of the flap 1150 facing the body of water can exist. This significant difference in fluid pressure can cause the flap 1150 to move into the open position, thereby allowing fluid in the inner cavity 1110 to drain through the aperture 1120 into the body of water as the watercraft moves in the forward direction. The configuration of the flap 1150 causing the flap 1150 to be in the closed position when the watercraft is moving in the rearward direction can prevent the insert 1100 from drawing in excessive water into the inner cavity 1110 through the aperture 1120 as the watercraft is moving in the rearward direction (e.g., as the watercraft is moving in a direction that does not create a low pressure region at the aperture 1120, thus causing water to have a tendency to flow from the body of water into the inner cavity 1110).

Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially be claimed as such, one or more features from a claimed combination can in some cases be excised from the combination, and the claim may be directed to a subcombination or variation of a subcombination.

Accordingly, other implementations are within the scope of the claims.

What is claimed is:

1. A watercraft comprising:

a hull;

an opening extending through the hull, the opening configured to receive a removable propulsion mechanism; and an insert removably insertable into the opening, wherein the insert comprises:

an inner cavity, an aperture located at a first location rearward of a second location, the aperture being configured to be at least partially submerged in a fluid when the watercraft is positioned on the fluid, and the aperture being configured to provide fluid communication between the inner cavity of the insert and the fluid as the watercraft travels in a forward direction, and a surface shaped and dimensioned such that a first pressure within the inner cavity is greater than a second pressure at the aperture as the watercraft travels in the forward direction and such that a first fluid pressure at the first location is lower than a second fluid pressure at the second location along the insert as the watercraft travels in the forward direction.

2. The watercraft of claim 1, wherein the opening is defined by the hull.

3. The watercraft of claim 1, further comprising:

a support assembly within the opening, wherein the support assembly is configured to receive the removable propulsion mechanism, and wherein the insert is removably insertable into the support assembly.

4. The watercraft of claim 1, wherein:

the first location is along a rear portion of the insert, and the second location is along a forward portion of the insert.

5. The watercraft of claim 1, wherein:

the surface is angled relative to the forward direction such that a forward portion of the surface is above a rearward portion of the surface.

6. The watercraft of claim 5, wherein:

the surface is substantially planar.

7. The watercraft of claim 1, wherein:

the insert comprises one or more lateral walls extending upwardly from the surface, the one or more lateral walls at least partially define the aperture and the inner cavity.

8. The watercraft of claim 1, wherein:

the insert comprises a lower wall and one or more lateral walls, the lower wall at least partially defining the surface, and the lower wall and the one or more lateral walls at least partially defining the inner cavity.

9. The watercraft of claim 8, wherein:

the one or more lateral walls are configured to extend along at least part of a perimeter of the opening when the insert is received within the opening.

10. The watercraft of claim 1, wherein:

the insert comprises a shaft on a first side portion of the insert, the shaft engageable with a bearing surface within the opening.

11. The watercraft of claim 10, further comprising:

a locking assembly to releasably lock the shaft of the insert to the watercraft when the insert is received within the opening.

12. The watercraft of claim 11, further comprising:

a support assembly within the opening, wherein the support assembly is configured to receive the removable propulsion mechanism, wherein the insert is removably insertable into the support assembly, and wherein the support assembly comprises the locking assembly.

13. The watercraft of claim 11, wherein:

the hull comprises the locking assembly.

14. The watercraft of claim 10, wherein:

the shaft is a first shaft, the bearing surface is a first bearing surface, the insert comprises a second shaft on a second side portion of the insert, the second shaft engageable with a second bearing surface.

15. The watercraft of claim 14, wherein:

the hull or a support assembly within the opening defines the first and second bearing surfaces.

16. The watercraft of claim 14, wherein:

the insert comprises a handle extending from the first shaft to the second shaft.

17. The watercraft of claim 1, wherein:

the insert comprises a longitudinal support member positioned to engage with a bearing surface within the opening.

18. The watercraft of claim 1, wherein:

the aperture is configured to extend to a location below the opening when the insert is mounted within the opening.

19. The watercraft of claim 1, further comprising:

the removable propulsion mechanism, wherein the removable propulsion mechanism is a pedal-driven system.

20. The watercraft of claim 1, wherein:

the surface is shaped and dimensioned such that the first pressure within the inner cavity is greater than the second pressure at the aperture when a speed of the watercraft as the watercraft travels in the forward direction is between 2.5 and 20 meters per second.

21. The watercraft of claim 1, wherein:

the surface is shaped and dimensioned such that a difference between the first pressure and the second pressure is between 6,250 and 400,000 MPa.

22. The watercraft of claim 1, wherein:

the insert comprises a flap adjacent to the aperture, the flap being movable between an open position and a closed position, and the flap being configured to be in the open position as the watercraft travels in the forward direction and configured to be in the closed position as the watercraft travels in a rearward direction.

23. An insert configured to be received in an opening extending through a hull of a watercraft, the opening being configured to receive a removable pedal-driven propulsion system, the insert comprising:

an inner cavity;

an aperture located at a first location rearward of a second location, the aperture being configured to be at least partially submerged in a fluid when the watercraft is positioned on the fluid, and the aperture being configured to provide fluid communication between the inner cavity of the insert and the fluid as the watercraft travels in a forward direction; and a surface shaped and dimensioned such that a first pressure within the inner cavity is greater than a second pressure at the aperture as the watercraft travels in the forward direction and such that a first fluid pressure at the first location is lower than a second fluid pressure at the second location along the insert as the watercraft travels in the forward direction.

24. The insert of claim 23, further comprising:

a lower wall defining the surface, and one or more lateral walls extending away from the lower wall, wherein the one or more lateral walls and the aperture extend along an entirety of a perimeter of the lower wall, wherein the inner cavity is at least partially defined by the lower wall and the one or more lateral walls.

25. The insert of claim 24, wherein:

the surface is angled relative to the forward direction such that a forward portion of the surface is above a rearward portion of the surface.

26. The insert of claim 23, further comprising:

a left shaft along a left side of the insert, the left shaft configured to bear against a left bearing surface in the opening of the watercraft when the insert is mounted to the watercraft, and a right shaft along a right side of the insert, the right shaft configured to bear against a right bearing surface in the opening of the watercraft when the insert is mounted to the watercraft.

27. The insert of claim 26, further comprising:

a forward support member along a forward portion of the insert, the forward support member configured to bear against a forward bearing surface in the opening of the watercraft when the insert is mounted to the watercraft, and a rearward support member along a rearward portion of the insert, the rearward support member configured to bear against a rearward bearing surface in the opening of the watercraft when the insert is mounted to the watercraft.

28. A watercraft comprising:

a hull;

an opening extending through the hull, the opening configured to receive a removable propulsion mechanism; and an insert removably insertable into the opening, wherein the insert comprises:

an inner cavity, an aperture configured to be at least partially submerged in a fluid when the watercraft is positioned on the fluid, the aperture being configured to provide fluid communication between the inner cavity of the insert and the fluid as the watercraft travels in a forward direction, and a surface shaped and dimensioned such that a first pressure within the inner cavity is greater than a second pressure at the aperture as the watercraft travels in the forward direction and when a speed of the watercraft as the watercraft travels in the forward direction is between 2.5 and 20 meters per second.

* * * * *